US010549539B2

(12) United States Patent
Katayama et al.

(10) Patent No.: US 10,549,539 B2
(45) Date of Patent: Feb. 4, 2020

(54) LIQUID DISCHARGE HEAD

(71) Applicant: Brother Kogyo Kabushiki Kaisha, Nagoya-shi, Aichi-ken (JP)

(72) Inventors: Hiroshi Katayama, Nagoya (JP); Keita Sugiura, Toyokawa (JP); Shohei Koide, Nagoya (JP); Jiro Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/207,791

(22) Filed: Dec. 3, 2018

(65) Prior Publication Data

US 2019/0291443 A1 Sep. 26, 2019

(30) Foreign Application Priority Data

Mar. 26, 2018 (JP) ..... 2018-058744

(51) Int. Cl.

| | |
|---|---|
| ***B41J 2/14*** | (2006.01) |
| ***B41J 2/175*** | (2006.01) |
| ***B41J 2/18*** | (2006.01) |
| ***B41J 11/00*** | (2006.01) |

(52) U.S. Cl.

CPC ..... *B41J 2/175* (2013.01); *B41J 2/14233* (2013.01); *B41J 2/18* (2013.01); *B41J 11/007* (2013.01); *B41J 2002/14241* (2013.01); *B41J 2002/14467* (2013.01); *B41J 2202/12* (2013.01)

(58) Field of Classification Search

CPC . B41J 2/14233; B41J 2/175; B41J 2/18; B41J 11/007; B41J 11/0085; B41J 29/38; B41J 2002/14241; B41J 2002/14467; B41J 2202/12

See application file for complete search history.

(56) References Cited

U.S. PATENT DOCUMENTS

| | | | |
|---|---|---|---|
| 7,971,981 B2 | 7/2011 | Nagashima et al. | |
| 7,976,139 B2 * | 7/2011 | Kyoso | B41J 2/14233 347/85 |

(Continued)

FOREIGN PATENT DOCUMENTS

| | | |
|---|---|---|
| JP | 2008-254196 A | 10/2008 |
| JP | 2009-179049 A | 8/2009 |
| JP | 2009-208445 A | 9/2009 |

*Primary Examiner* — Anh T Vo

(74) *Attorney, Agent, or Firm* — Banner & Witcoff, Ltd.

(57) ABSTRACT

There is provided a liquid discharge head including: a plurality of individual channels arranged in a row in a first direction; an inflow channel extending in the first direction and connected to the plurality of individual channels; and an outflow channel extending in the first direction and connected to the plurality of individual channels, wherein first connecting parts connected respectively to the plurality of individual channels are provided on both end parts in a second direction of an upper surface of the outflow channel, the second direction being horizontal and orthogonal to the first direction; the upper surface of the outflow channel has a convex part having a shape which is, as projected in the first direction, convex upward; and a highest point of the convex part is located, in the second direction, between the both end parts in the second direction of the upper surface of the outflow channel.

19 Claims, 17 Drawing Sheets

(56) References Cited

U.S. PATENT DOCUMENTS

| | | | | |
|---|---|---|---|---|
| 8,657,415 | B2 * | 2/2014 | Kumagai | B41J 2/14274 347/65 |
| 9,221,247 | B2 * | 12/2015 | Cruz-Uribe | B41J 2/14233 |
| 2008/0030553 | A1 * | 2/2008 | Takahashi | B41J 2/04581 347/70 |
| 2008/0136860 | A1 * | 6/2008 | Kyoso | B41J 2/175 347/19 |
| 2008/0238980 | A1 | 10/2008 | Nagashima et al. | |
| 2018/0069093 | A1 * | 3/2018 | Qian | G11C 11/417 |

* cited by examiner

LIQUID DISCHARGE HEAD

CROSS REFERENCE TO RELATED APPLICATION

The present application claims priority from Japanese Patent Application No. 2018-058744 filed on Mar. 26, 2018 the disclosure of which is incorporated herein by reference in its entirety.

BACKGROUND

Field of the Invention

The present disclosure relates to a liquid discharge head which discharges liquid from a nozzle.

Description of the Related Art

There is known a liquid discharge head, as a publicly known liquid droplet discharge head, wherein a nozzle and a pressure chamber are connected via a communicating passage extending in an up-down direction; the pressure chamber is connected to a common channel for supply (supplying common channel) via a supplying passage; and a lower end part of the communicating passage is connected to a common channel for circulation (circulating common channel) via a circulating passage. Further, in the above-described liquid discharge head, a connecting part with respect to the supply channel is provided on an upper surface of the supplying common channel. Furthermore, in the above-described liquid discharge head, a liquid flows into the circulating common channel, from the supplying common channel, via in the following orders: the supplying passage, the pressure chamber, the communicating passage and the circulating passage. This flow of the liquid causes the circulation of the liquid inside an individual channel formed by the nozzle, the pressure chamber, the communicating passage, the supplying passage and the circulating passage, and makes it possible, for example, to allow any air bubble, which enters into the individual channel from the nozzle, to be discharged (exhausted) to the circulating common channel.

SUMMARY

Here, in the above-described liquid discharge head (liquid droplet discharge head), such a case is assumed that the liquid is allowed to flow form the circulating common channel into the supplying common channel via the circulating passage, the communicating passage, the pressure chamber and the supplying passage. In such a case, the liquid inside the individual channel is allowed to circulate to thereby allow any air bubble, which has entered into the individual channel from the nozzle, to be discharged to the supplying common channel. In this case, however, the discharged air bubble is accumulated (allowed to stay) at an upper end part of the supplying common channel. In order to address to this situation, in the above-described liquid discharge head however, the connecting part with respect to the supplying passage is provided on the upper surface of the supplying common channel. Due to this configuration, there is such a fear that the air bubble discharged to the supplying common channel might flow backward (flows reversely) to the individual channel.

An object of the present disclosure is to provide a liquid discharge head in which a connecting part with respect to an individual channel is provided on an upper end part of an outflowing channel allowing a liquid to flow out therethrough from the individual channel, and which is capable of preventing any ai bubble, discharged from the individual channel to the outflowing channel, from flowing reversely from the outflowing channel to the individual channel.

According to an aspect of the present disclosure, there is provided a liquid discharge head, including: a plurality of individual channels arranged in a row in a first direction which is horizontal, the plurality of individual including a plurality of nozzles, respectively; an inflow channel extending in the first direction, connected to the plurality of individual channels and configured to allow liquid to inflow therethrough into the plurality of the individual channels; and an outflow channel extending in the first direction, connected to the plurality of individual channels and configured to allow the liquid to outflow therethrough from the plurality of the individual channels. First connecting parts connected respectively to the plurality of individual channels are provided on both end parts in a second direction of an upper surface of the outflow channel, the second direction being horizontal and orthogonal to the first direction. The upper surface of the outflow channel has a convex part having a shape which is, as projected in the first direction, convex upward. A highest point of the convex part is located, in the second direction, between the both end parts in the second direction of the upper surface of the outflow channel.

DESCRIPTION OF THE EMBODIMENTS

First Embodiment

In the following, a first embodiment of the present disclosure will be explained, with reference to the drawings as appropriate.

<Overall Configuration of Printer 1>

Figure 1:
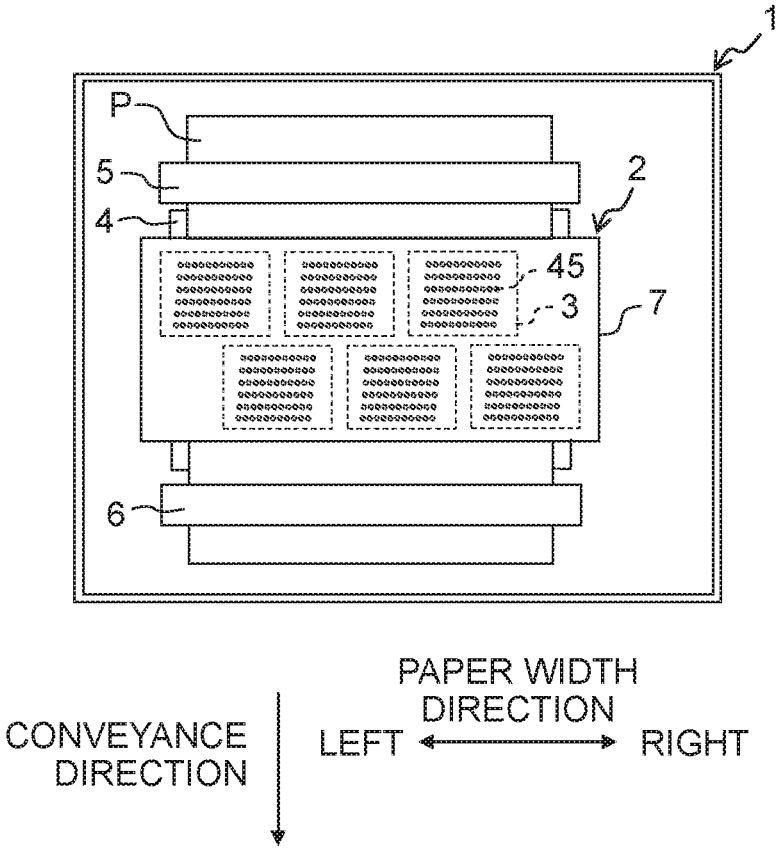
FIG. 1 is a view depicting the schematic configuration of a printer 1 according to a first embodiment of the present disclosure.

As depicted in FIG. 1, a printer 1 according to a first embodiment of the present disclosure is provided with an ink-jet head 2, a platen 4, conveyance rollers 5 and 6, etc.

The head unit 2 is a so-called line head, and is provided with six head units 3 (corresponding to a "liquid discharge head" of the present disclosure), and a frame 7 to which the six head units 3 are attached. Each of the head units 3 jets (discharges) an ink from a plurality of nozzles 45 formed in a lower surface of the head unit 3.

Further, the six head units 6 are arranged side by side in a paper width direction (corresponding to a "first direction") such that three head units 6 among the six head units 6 each form a row of the head units 3, thereby providing two rows of the head units 3. These two rows of the head units 3 are arranged side by side in a conveyance direction (corresponding to a "second direction" of the present disclosure) which is orthogonal to the paper width direction. Further, between these two rows, positions in the paper width direction of the head units 3 are shifted. With this, the six head units 3 are arranged in the paper width direction, along the entire length of recording paper (recording paper sheet, recording sheet) P. The head unit 3 will be explained in detail, later on. Note that in the following, the explanation will be given, with the right side and the left side in the paper width direction as being defined as depicted in FIG. 1.

The platen 4 is arranged to face (to be opposite to) the lower surfaces of the six head units 3, and extends in the paper width direction, along the entire length of the paper sheet P. The platen 4 supports the recording paper P from therebelow. The conveyance rollers 5 and 6 are located respectively on the upstream side and the downstream side in the conveyance direction of the carriage 2; the conveyance direction is horizontal and orthogonal to the paper width direction. The conveyance rollers 5 and 6 convey the recording paper P in the conveyance direction.

Further, in the printer 1, printing is performed on the recording paper P by jetting the ink from the plurality of nozzles 45 of the six head units 6, while conveying the recording paper P in the conveyance direction by the conveyance rollers 5 and 6.

<Head Unit 3>

Next, the head units 3 will be explained in detail. As depicted in FIGS. 2 to 8, each of the head units 3 is provided with: a channel unit 11 (flow channel unit 11) formed with an ink channel including the nozzles 45, a plurality of pressure chambers 40 (to be described later on), etc.; and a piezoelectric actuator 12 configured to apply pressure to the ink inside each of the pressure chambers 40.

<Channel Unit 11>

The channel unit 11 is formed of 11 pieces of plates 20 to 30 which are stacked from the upper side in this order. The channel unit 11 is formed with a plurality of pressure chambers 40, a plurality of throttle channels 41, a plurality of descender channels 42, a plurality of linking channels 43, a plurality of nozzles 45, three supplying manifold 46 (corresponding to an "inflow channel" of the present disclosure), four returning manifolds 47 (corresponding to an "outflow channel" of the present disclosure), and a bypass channel 48.

The plurality of pressure chambers 40 are formed in the plate 20. Each of the pressure chambers 40 has a planar shape which is rectangular; the conveyance direction is the longitudinal direction of the pressure chamber 40. Further, the plurality of pressure chambers 40 are arranged side by side in the paper width direction to thereby form a pressure chamber row 39. Furthermore, in the plate 20, twelve pieces of the pressure chamber row 39 are arranged side by side in the conveyance direction. Moreover, among the pressure chamber rows 39, the positions in the paper width direction of the pressure chambers 40 are shifted from one another.

The plurality of throttle channels 41 are formed to span across the plates 21 and 22. Each of the plurality of throttle channels 41 is provided individually on one of the plurality of pressure chambers 40. A throttle channel 41, included in the plurality of throttle channels 41 and provided on a pressure chamber 40 constructing each of odd-numbered pressure chamber rows 39 from the upstream side in the conveyance direction, is connected to an end part on the upstream side in the conveyance direction of the pressure chamber 40, and is extended from a connecting part with respect to the pressure chamber 40 toward the upstream side in the conveyance direction. A throttle channel 41, included in the plurality of throttle channels 41 and provided on a pressure chamber 40 constructing each of even-numbered pressure chamber rows 39 from the upstream side in the conveyance direction, is connected to an end part on the downstream side in the conveyance direction of the pressure chamber 40, and is extended from a connecting part with respect to the pressure chamber 40 toward the downstream side in the conveyance direction.

The plurality of descender channels 42 are formed by allowing through holes formed in the plates 21 to 29, respectively, to overlap with one another in the up-down direction. Each of the plurality of descender channels 42 is provided individually on one of the plurality of pressure chambers 40. A descender channel 42, included in the plurality of descender channels 42 and provided on the pressure chamber 40 constructing each of the odd-numbered pressure chamber rows 39 from the upstream side in the conveyance direction, is connected to the end part on the downstream side in the conveyance direction of the pressure chamber 40, and is extended downward from a connecting part with respect to the pressure chamber 40. A descender channel 42, included in the plurality of descender channels 42 and provided on the pressure chamber 40 constructing each of the even-numbered pressure chamber rows 39 from the upstream side in the conveyance direction, is connected to the end part on the upstream side in the conveyance direction of the pressure chamber 40, and is extended downward from a connecting part with respect to the pressure chamber 40.

The plurality of linking channels 43 are formed in the plate 29. Each of the plurality of linking channels 43 extends in an inclined direction which is horizontal and is inclined with respect to the paper width direction and the conveyance direction; each of the linking channels 43 connects, in two adjacent pressure chamber rows 39, a lower end part of a descender channel 42 connected to a pressure chamber 40 constructing one of the two adjacent pressure chamber rows 39 and a lower end part of a descender channel 42 connected to a pressure chamber 40 constructing the other of the two adjacent pressure chamber rows 39. To explain more specifically, the plate 29 is formed with a through hole in which a portion forming the above-described two descender channels 42 and a portion forming the linking channel 43 are integrated. For example, the thickness of the plate 29 is approximately 0.1 mm; this makes the height of the linking channel 43 formed by the through hole of the plate 29 to be also approximately 0.1 mm.

The plurality of nozzles 45 are formed in the plate 30. Each of the plurality of nozzles 45 is provided individually on one of the plurality of linking channels 43, and is connected to a central portion of one of the plurality of linking channels 43.

Further, the channel unit 11 is formed with the plurality of individual channels 38 each having one nozzle 45, one linking channel 43 linking to the one nozzle 45, two descender channels 42 connected to the one linking channel 43, two pressure chambers 40 connected to the two descender channels 42, respectively, and two throttle channels 41 connected to the two pressure chambers 40, respectively. The plurality of individual channels 38 are aligned in the paper width direction so as to form an individual channel row 37. Furthermore, in the channel unit 11, six pieces of the individual channel row 37 are arranged side by side along the conveyance direction.

As depicted in FIGS. 2 to 7, the three supplying manifolds 46 are each formed by allowing through holes formed in the plates 23 to 27, respectively, to overlap in the up-down direction with a recessed part (concaved part) formed in an upper part of the plate 28. The three supplying manifolds 46 each extend in the paper width direction, and are arranged side by side in the conveyance direction with an interval therebetween. Further, the three supplying manifolds 46 are connected, in an order of arrangement thereof from the upstream-most side in the conveyance direction, to end parts on the opposite side to the pressure chambers 40 of the throttle channels 41 connected respectively to the pressure chambers 40 constructing the second, third, sixth, seventh, tenth and eleventh pressure chamber rows 39 from the upstream side in the conveyance direction. Namely, the throttle channels 41 corresponding to two of the pressure chamber rows 39 are connected to each of the supplying manifolds 46.

Further, in the first embodiment, connecting parts 49 connected respectively to the throttle channels 41, corresponding to a pressure chamber row 39 included in the above-described two pressure chamber rows 39 and which is located on the downstream side in the conveyance direction, are provided on an end part on the upstream side in the conveyance direction of the upper surface of each of the respective supplying manifolds 46. Furthermore, connecting parts 49 connected respectively to the throttle channels 41, corresponding to a pressure chamber row 39 included in the above-described two pressure chamber rows 39 and which is located on the upstream side in the conveyance direction, are provided on an end part on the downstream side in the conveyance direction of the upper surface of each of the respective supplying manifolds 46.

Namely, the connecting parts 49 connected respectively to the throttle channels 41 are provided respectively on the both end parts in the conveyance direction of the upper surface of each of the supplying manifolds 46. Here, the "both end parts in the conveyance direction of the upper surface of each of the supplying manifolds 46" indicates parts or portions in the upper surface of the supplying manifold 46 each of which is separated and away from a central part or portion in the conveyance direction of the supplying manifold 46 by a distance which is not less than half the height of the supplying manifold 46. Alternatively, the "both end parts in the conveyance direction of the upper surface of each of the supplying manifolds 46" indicates parts or portions in the upper surface of the supplying manifold 46 each having a distance from the central part or portion in the conveyance direction of the supplying manifold 46 which is greater (farther) than a distance from one of the wall surfaces on the both ends in the conveyance direction of the supplying manifold 46.

Further, in the supplying manifold 46, a distance from the center of a curved surface 51 (the highest point (summit) which is to be described later on) to a part or portion, of the connecting part 49 closer to the center of the curved surface 51 is approximately in a range of 0.5 mm to 0.6 mm, whereas a distance from the center of the curved surface 51 and each of the wall surfaces on the both ends of the supplying manifold 46 is approximately in a range of 0.7 to 0.8 mm.

Figure 4A:
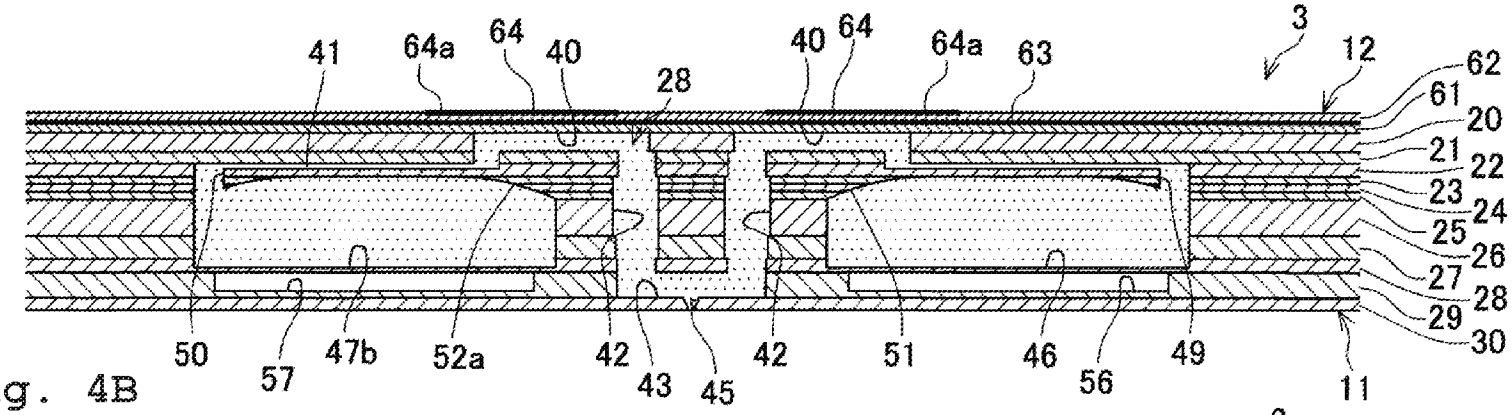
FIG. 4A is a cross-sectional view taken along a line IVA-IVA in FIG. 3.
Figure 4B:
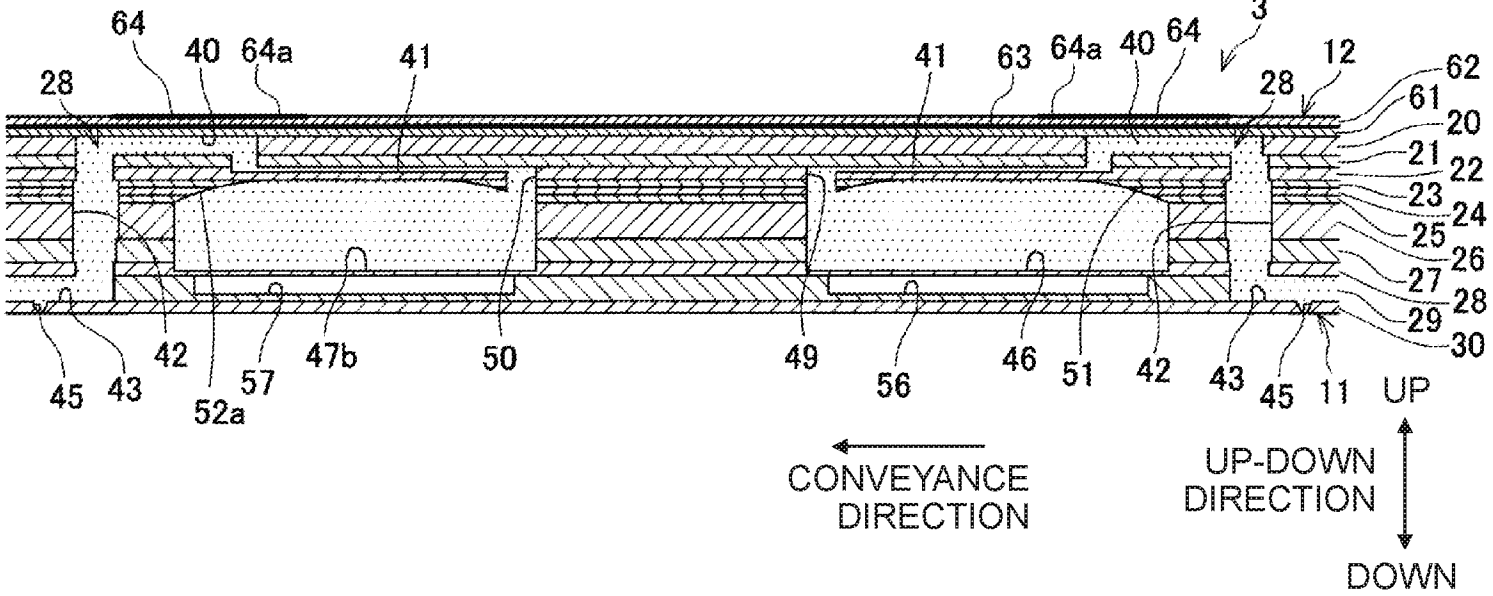
FIG. 4B is a cross-sectional view taken along a line IVB-IVB in FIG. 3.
Figure 5B:
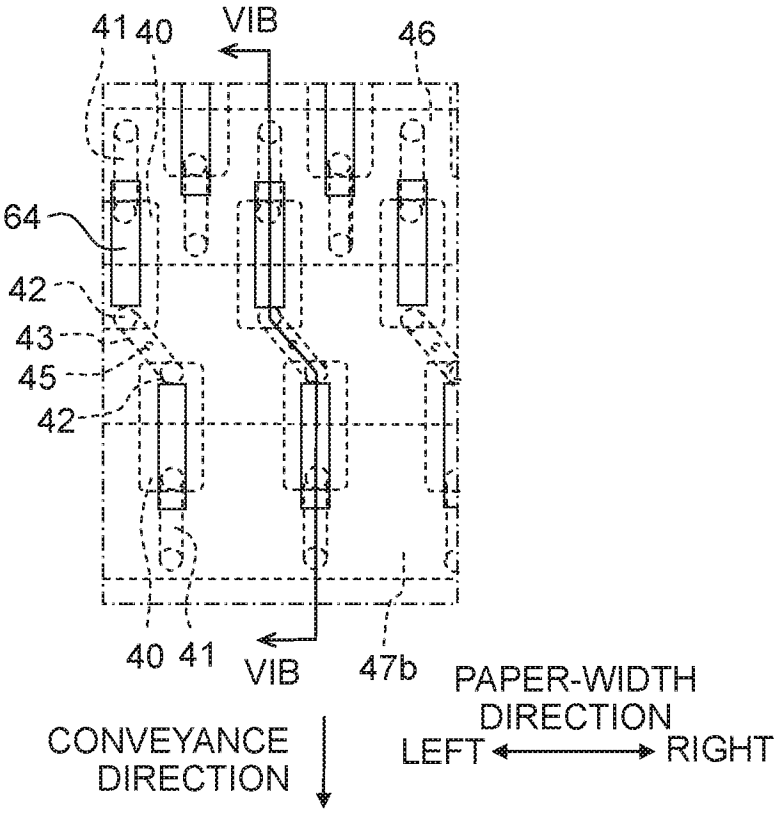
FIG. 5B is an enlarged view of a "C" part in FIG. 2.
Figure 5A:
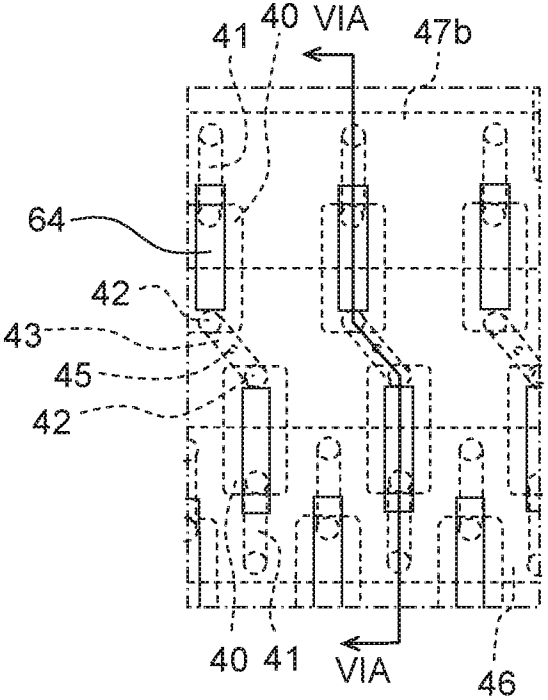
FIG. 5A is an enlarged view of a "B" part in FIG. 2.

Furthermore in the first embodiment, with respect to the configuration wherein the connecting parts 49 connected respectively to the throttle channels 41 are provided respectively on the both end parts in the conveyance direction of the upper surface of each of the supplying manifolds 46, the upper surface of the supplying manifold 46 is a curved surface 51 having a shape which is, as projected in the paper width direction, convex upward (corresponding to a "convex part" of the present disclosure), as depicted in FIGS. 4A and 4B. Moreover, the highest point (summit) of the curved surface 51 is located in the central part in the conveying direction of the curved surface 51. The curved surface 51 extends over the entire length in the paper width direction of the supplying manifold 46, including a part or portion of the supplying manifold 46 formed with the connecting parts 49 with respect to the individual channels 38 and a part formed with a supply port 46*a* (which will be described later on).

Further in the first embodiment, a distance from the highest point (summit) of the curved surface 51 to a lower surface of the supplying manifold 46 is approximately in a range of 0.4 mm to 0.5 mm in the supplying manifold 46. With this, it is possible to make the volume of the supplying manifold 46 to be great to such an extent that makes it possible to store the ink in a sufficient amount in the plurality of individual channels 38 (to such an extent that any insufficiency of refilling does not occur).

Note that in the first embodiment, a part or portion, of the individual channel 38, which includes a part or portion of the linking channel 43, one descender channel 42, one pressure chamber 40, and one throttle channel 41 and which connects one nozzle 45 and the supplying manifold 46 with each other corresponds to a "first channel part" of the present disclosure, and the above-described one pressure chamber 40 included in the first channel part corresponds to a "first pressure chamber" of the present disclosure.

The four returning manifolds 47 are each formed by allowing through holes formed in the plates 23 to 27, respectively, to overlap with a recessed part formed in an upper part of the plate 28 in the up-down direction. The four returning manifolds 47 each extend in the paper width direction, are arranged alternately with the supplying manifolds 46 in the conveyance direction. Further, the four returning manifolds 47 are connected, in an order of arrangement thereof from the upstream-most side in the conveyance direction, to end parts on the opposite side to the pressure chambers 40 of the throttle channels 41 connected respectively to the pressure chambers 40 constructing the first, fourth and fifth, eighth and ninth, and twelfth pressure chamber rows 39 from the upstream side in the conveyance direction. Namely, the throttle channels 41 corresponding to two of the pressure chamber rows 39 are connected to each of two returning manifolds 47*a* (corresponding to "inner-side outflow channels" of the present disclosure) located at the inner side in the conveyance direction among the four returning manifolds 47. Furthermore, the throttle channels 41 corresponding to one of the pressure chamber rows 39 are connected to each of two returning manifolds 47*b* (corresponding to "outer-side outflow channels" of the present disclosure) located respectively at the outermost sides in the conveyance direction among the four returning manifolds 47.

Moreover, connecting parts 50 connected respectively to the throttle channels 41, corresponding to a pressure chamber row 39 included in the above-described two pressure chamber rows 39 and which is located on the downstream side in the conveyance direction, are provided on an end part on the upstream side of the upper surface of each of the respective returning manifolds 47*a*. Further, connecting parts 50 connected respectively to the throttle channels 41, corresponding to a pressure chamber row 39 included in the above-described two pressure chamber rows 39 and which is located on the upstream side in the conveyance direction, are provided on an end part on the downstream side of the upper surface of each of the respective returning manifolds 47*a*.

Namely, the connecting parts 50 connected to the throttle channels 41 are provided respectively on the both end parts in the conveyance direction of the upper surface of each of the returning manifolds 47*a*. Here, the "both end parts in the conveyance direction of the upper surface of each of the returning manifolds 47*a*" indicates parts or portions in the upper surface of the returning manifold 47*a* each of which is separated and away from a central part or portion in the conveyance direction of the returning manifold 47*a* by a distance which is not less than half the height of the returning manifold 47*a*. Alternatively, the "both end parts in the conveyance direction of the upper surface of each of the returning manifolds 47*a*" indicates parts or portions in the upper surface of the returning manifold 47*a* each having a distance from the central part or portion in the conveyance direction of the returning manifold 47*a* which is greater (farther) than a distance from one of the wall surfaces on the both ends in the conveyance direction of the returning manifold 47*a*.

Further, in the returning manifold 47*a*, a distance from the center of a curved surface 51 (the highest point (summit) which is to be described later on) to a part or portion, of the connecting part 50 closer to the center of a curved surface 52*a* is approximately in a range of 0.5 mm to 0.6 mm, whereas a distance from the center of the curved surface 51 and each of the wall surfaces on the both end parts of the returning manifold 47*a* is approximately in a range of 0.7 to 0.8 mm.

Furthermore, with respect to the configuration wherein the connecting parts 50 connected respectively to the throttle channels 41 are provided respectively on the both end parts in the conveyance direction of the upper surface of each of the returning manifolds 47*a*, the upper surface of the returning manifold 47*a* is a curved surface 52*a* having a shape which is, as projected in the paper width direction, convex upward (corresponding to a "convex part" of the present disclosure), as depicted in FIGS. 4A and 4B. Moreover, the highest point (summit) of the curved surface 52*a* is located in the central part in the conveying direction of the curved surface 52*a*. The curved surface 52*a* extends over the entire length in the paper width direction of the returning manifold 47*a*, including a part or portion of the returning manifold 47*a* formed with the connecting parts 50 with respect to the individual channels 38 and a part formed with a discharge port 47*c* (which will be described later on).

Figure 6A:
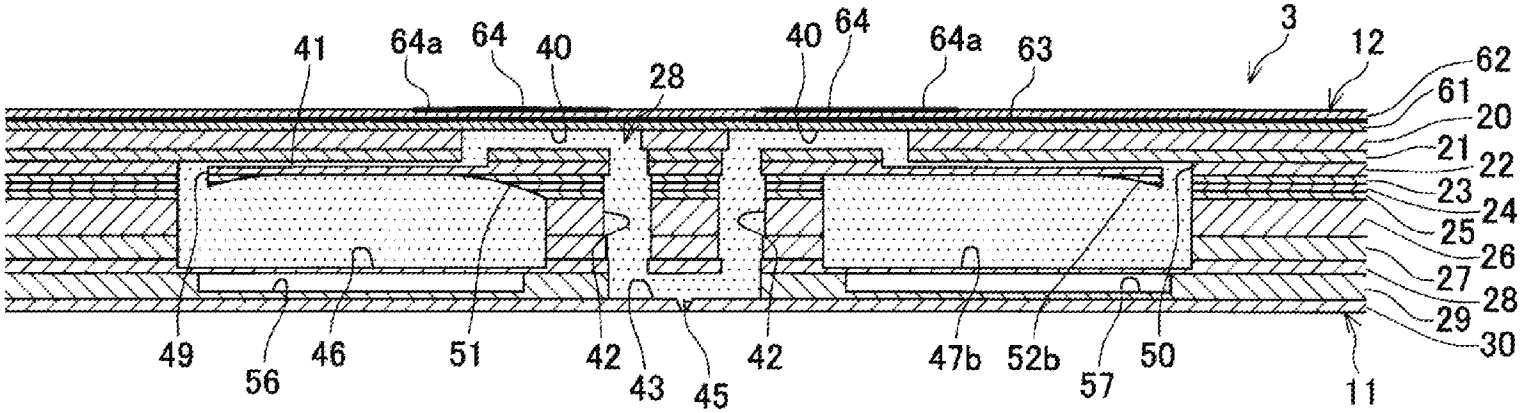
FIG. 6A is a cross-sectional view taken along a line VIA-VIA in FIG. 5A.
Figure 6B:
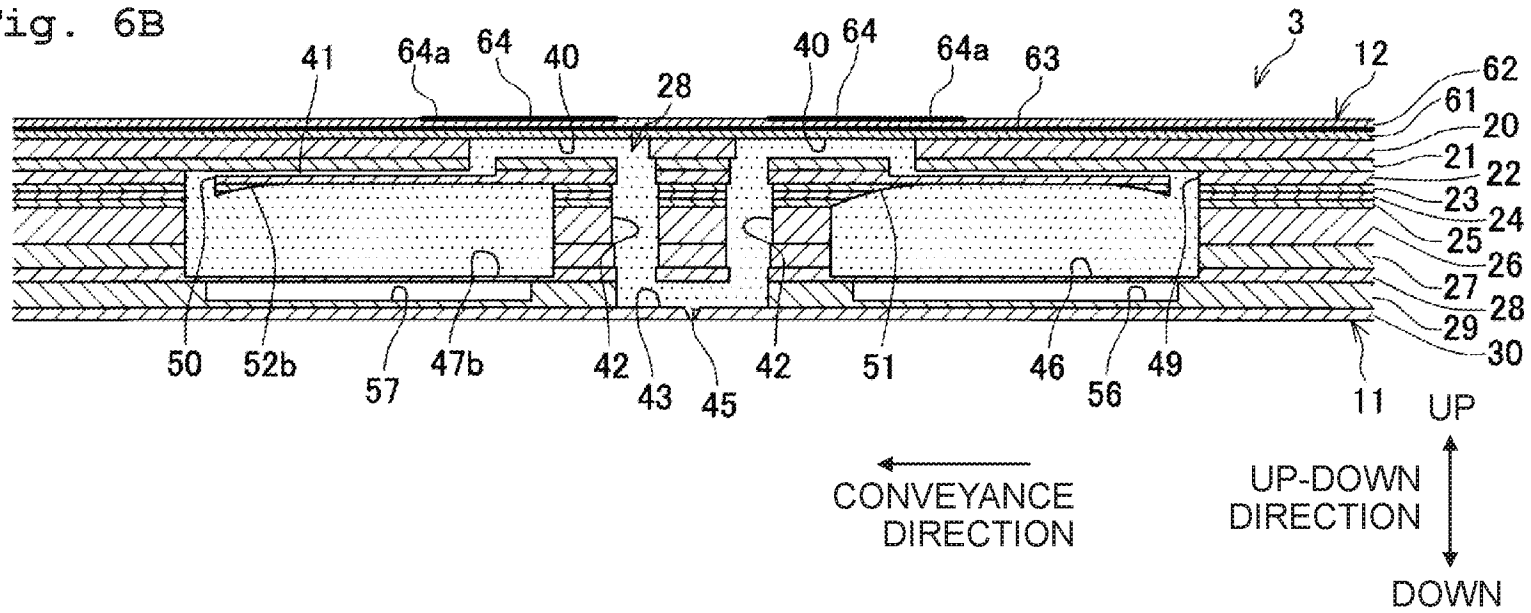
FIG. 6B is a cross-sectional view taken along a line VIB-VIB in FIG. 5B.

Moreover, the connecting parts 50 connected respectively to the throttle channels 41 corresponding to the one pressure chamber row 39 are provided on an end part on the outer side, in the conveyance direction of the upper surface of each of the returning manifolds 47*b*. Corresponding to this configuration, in the first embodiment, the upper surface of the returning manifold 47*b* is a curved surface 52*b* having a shape which is, as projected in the paper width direction, convex upward (corresponding to a "convex part" of the present disclosure), as depicted in FIGS. 6A and 6B. Further, the highest point (summit) of the curved surface 52*b* is located in an end part on the inner side in the conveyance direction of the curved surface 52*a* (on the opposite side to the connecting part 50). The curved surface 52*b* extends over the entire length in the paper width direction of the returning manifold 47*b*, including a part or portion of the returning manifold 47*b* formed with the connecting parts 50 with respect to the individual channels 38 and a part formed with the discharge port 47*c*.

Note that in the first embodiment, a part or portion (connecting part or portion), of the individual channel 38, which includes a part or portion of the linking channel 43, one descender channel 42, one pressure chamber 40, and one throttle channel 41 and which connects one nozzle 45 and the returning manifold 47*a* or 47*b* with each other corresponds to a "second channel part" of the present disclosure, and the above-described one pressure chamber 40 included in the second channel part corresponds to a "second pressure chamber" of the present disclosure.

Here, in a case, for example, that the jetting (discharging) of the ink from the nozzles 45 is not performed for a long period of time in the head unit 3, the particles of a pigment in the ink sediment (settle) in a lower end part of the supplying manifold 46 and/or in a lower end part of the returning manifold 47, in some cases. In such a situation, provided, unlike in the first embodiment, that a connecting part with respect to the throttle channel 41 is provided on the lower end part of the supplying manifold 46 and/or on the lower end part of the returning manifold 47, there is such a fear that these connecting parts might be clogged by the sediment particles of the pigment and that the ink might not easily flow therethrough. In view of such a situation, in the first embodiment, the connecting part 49 with respect to the throttle channel 41 is provided on the upper surface of the supplying manifold 46, and the connecting part 50 with respect to the throttle channel 41 is provided on the upper surface of each of the returning manifolds 47*a* and 47*b*, as described above. With this, the connecting parts 49 and 50 are not clogged by any sediment particles of the pigment.

Figure 2:
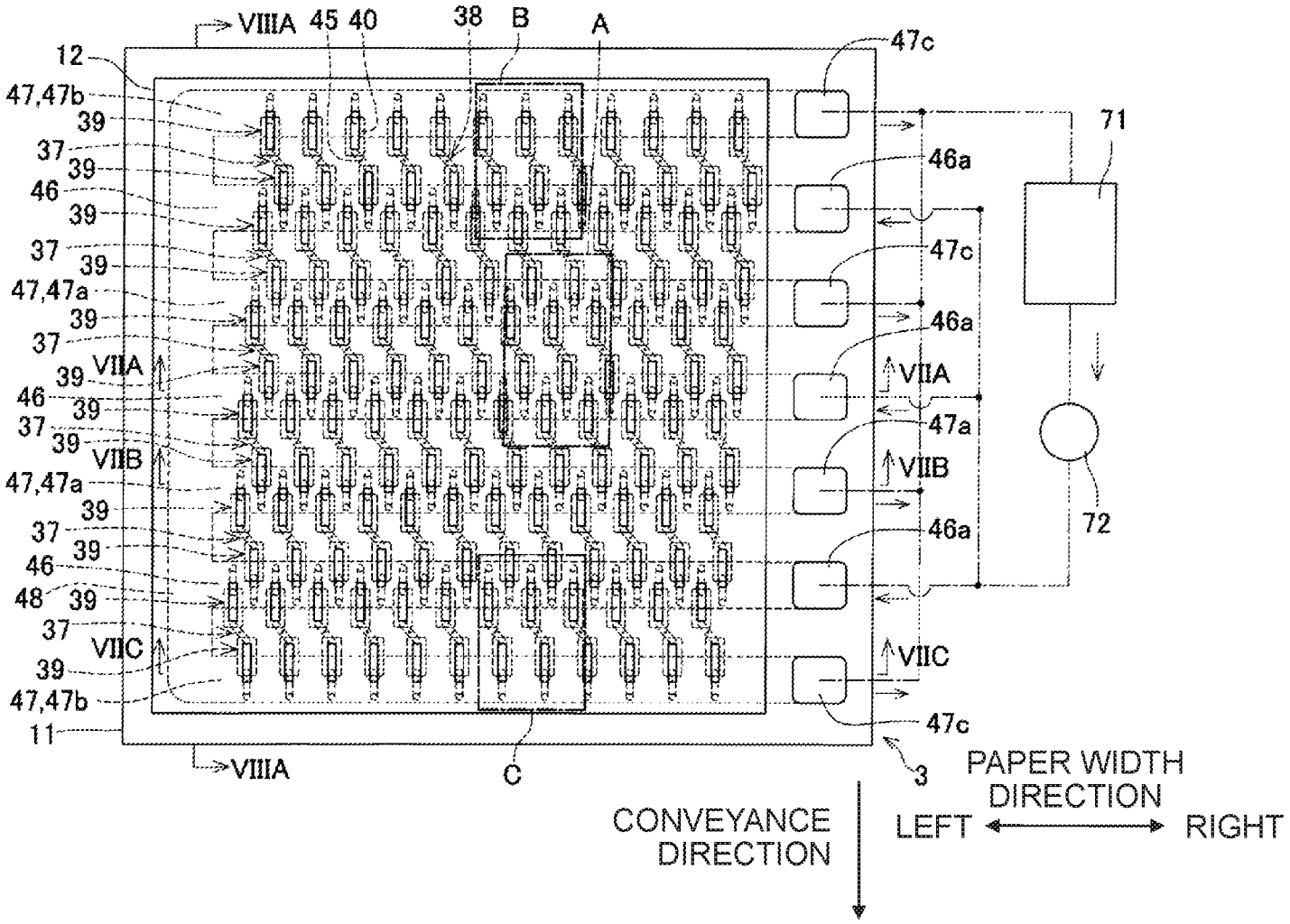
FIG. 2 is a plane view of a head unit 3 according to the first embodiment.
Figure 3:
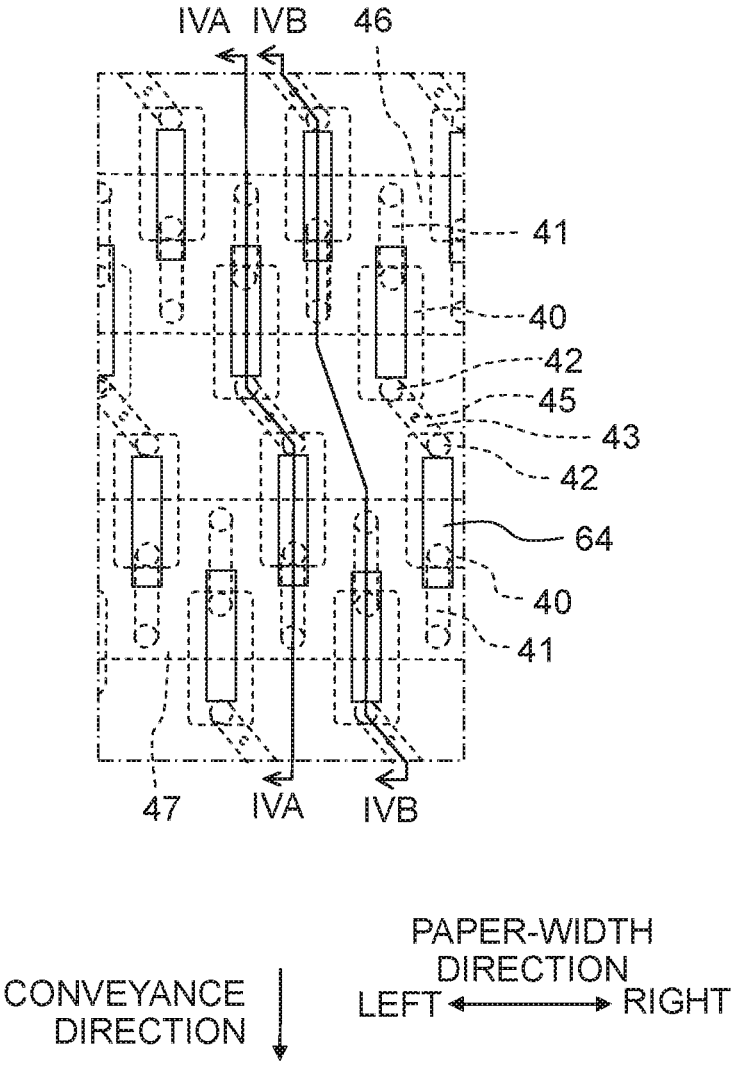
FIG. 3 is an enlarged view of an "A" part in FIG. 2.
Figures 7A, 7B, 7C:
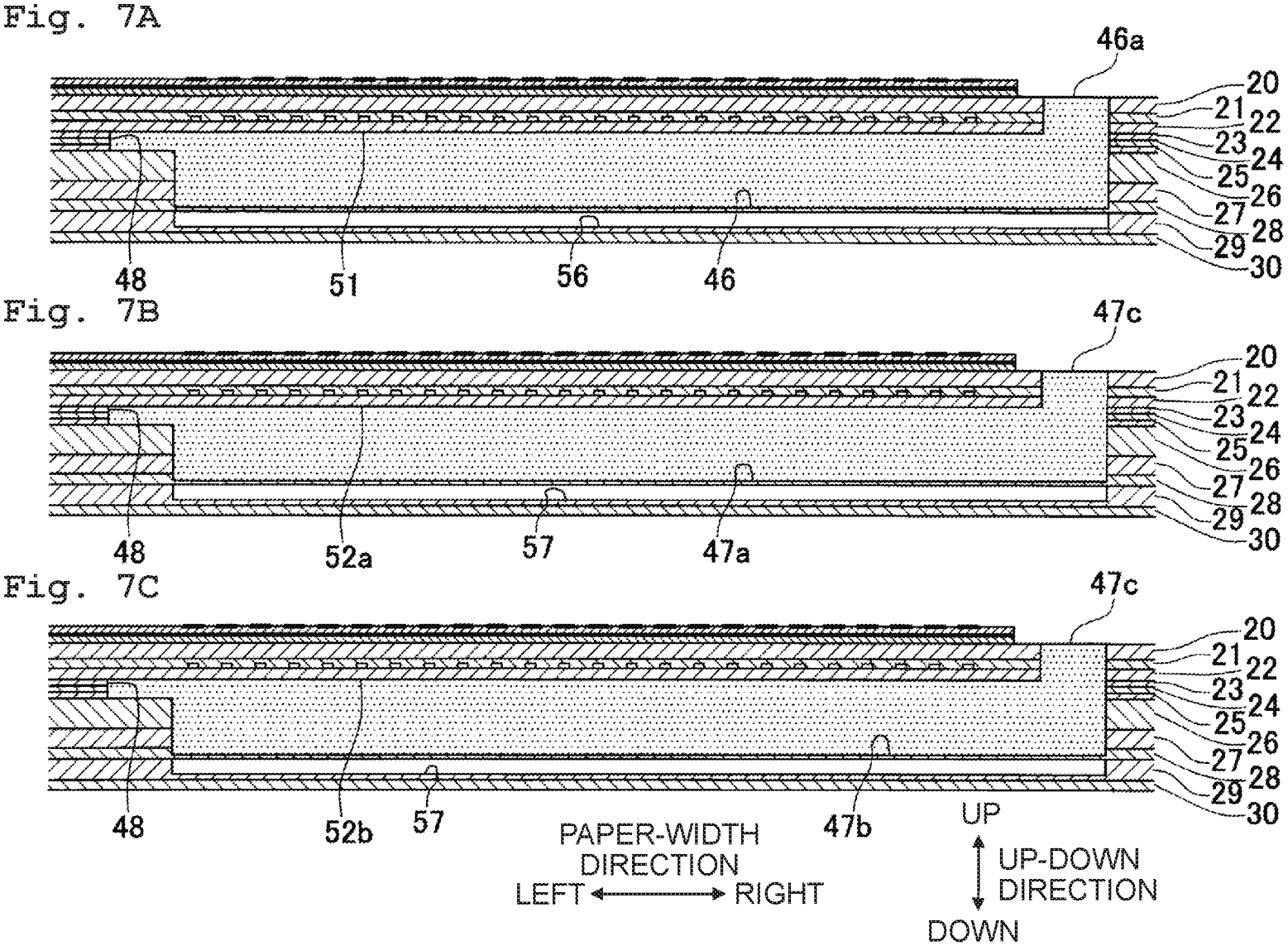
FIG. 7A is a cross-sectional view taken along a line VIIA-VIIA in FIG. 2.
FIG. 7B is a cross-sectional view taken along a line VIIB-VIIB in FIG. 2.
FIG. 7C is a cross-sectional view taken along a line VIIC-VIIC in FIG. 2.
Figure 8A:
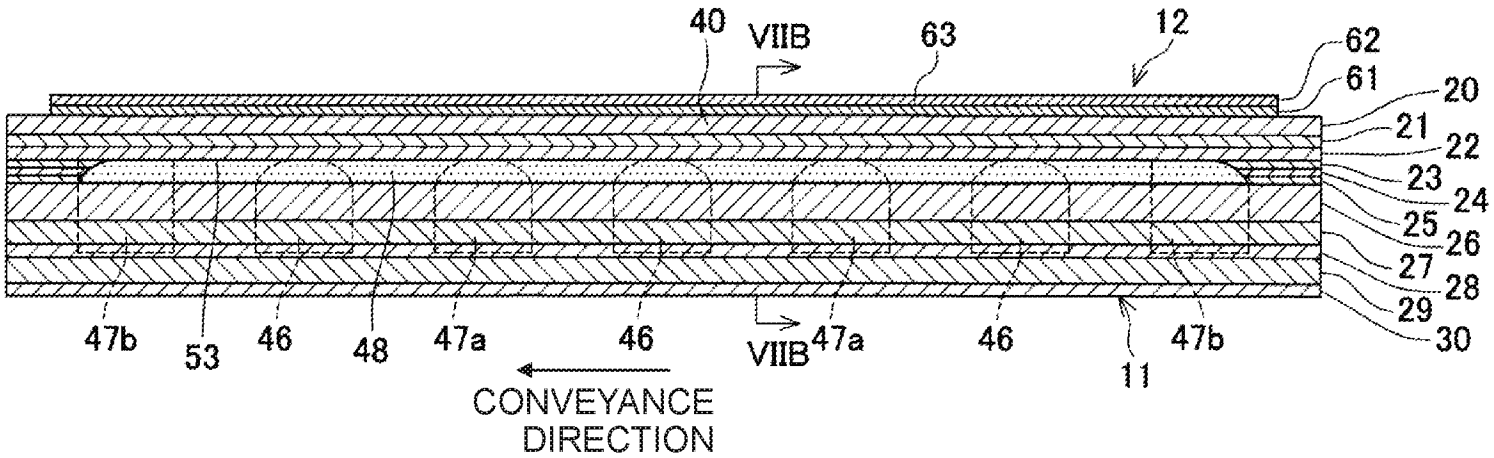
FIG. 8A is a cross-sectional view taken along a line VIIIA-VIIIA in FIG. 2.
Figure 8B:
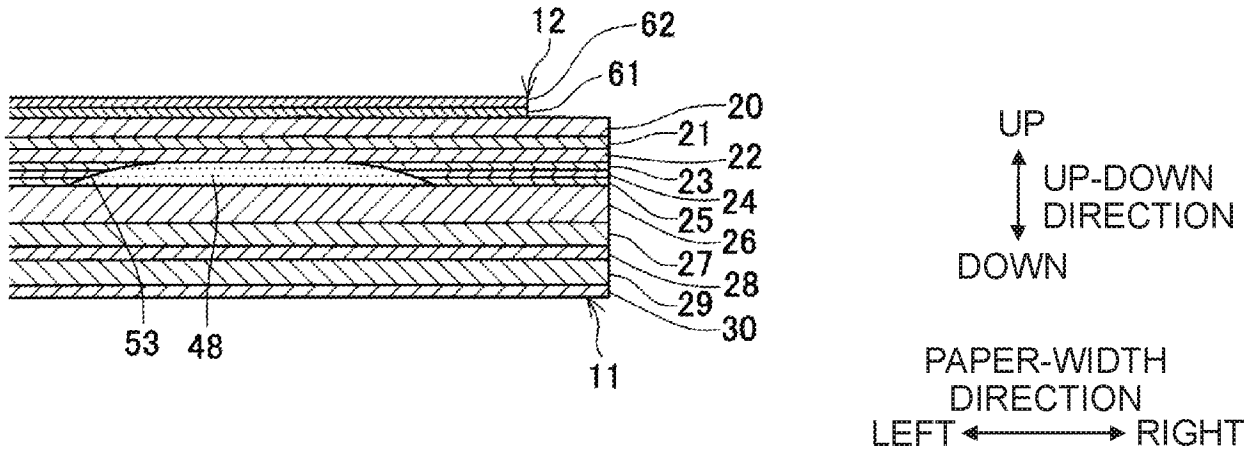
FIG. 8B is a cross-sectional view taken along a line VIIIB-VIIIB in FIG. 8A.
Figure 9:
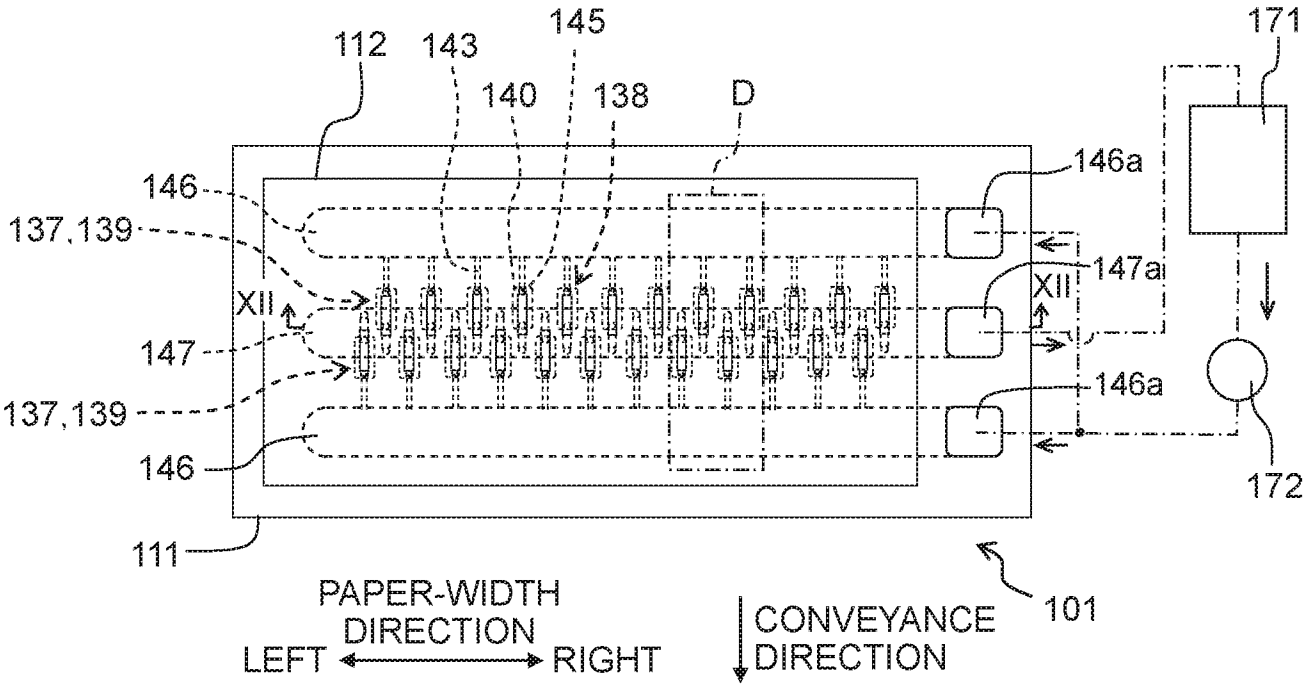
FIG. 9 is a plane view of a head unit 101 according to a second embodiment.
Figure 10:
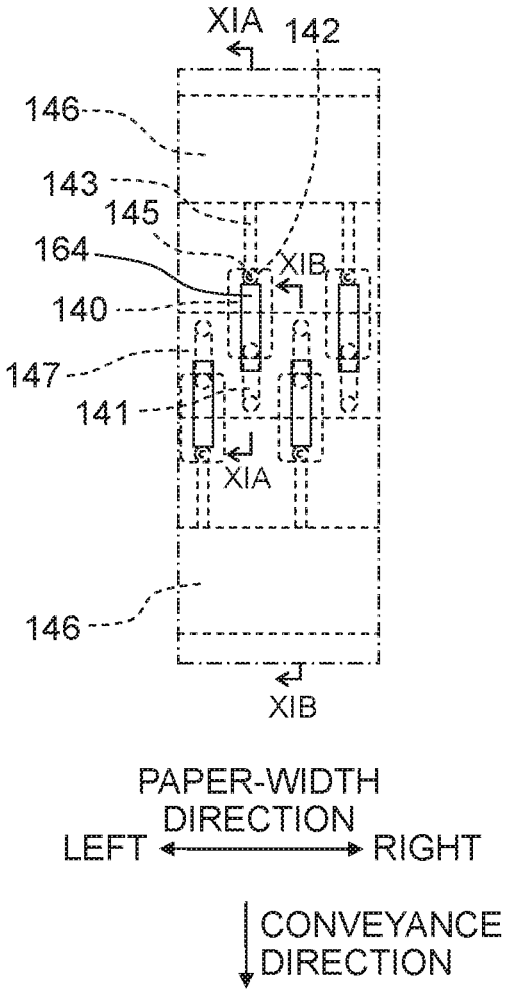
FIG. 10 is an enlarged view of a "D" part in FIG. 9.

Further, as depicted in FIGS. 2 and 7A, each of the supplying manifolds 46 extends in the up-down direction across the plates 20 to 28 at a right-side end part thereof in the paper width direction, and a supply port 46*a* is provided on an upper end part of the right-side end part. Three ink supply ports 46*a* of the three supplying manifolds 46 are communicated with one another, and are connected to an ink tank 71 via a pump 72 for circulation (circulating pump 72). The ink tank 71 is connected to an unillustrated ink cartridge via an unillustrated tube, etc., and the ink is supplied from the ink cartridge to the ink tank 71.

Furthermore, as depicted in FIGS. 2, 7B and 7C, each of the returning manifolds 47 (47*a*, 47*b*) extends in the up-down direction across the plates 20 to 28 at a right-side end part thereof in the paper width direction, and a discharge port 47*c* is provided on an upper end part of the right-side end part. Four discharge ports 47*c* of the four returning manifolds 47 are communicated with one another, and are connected to the ink tank 71.

In a case that the circulating pump 72 is driven, the ink inside the ink tank 71 flows from the supply ports 46*a* into the supplying manifolds 46. Further, the ink flows from the supplying manifolds 46 into the plurality of individual channels 38, and the ink flows from the plurality of individual channels 38 into the returning manifolds 47. Furthermore, the ink inside the returning manifolds 47 flows out from the discharge ports 47*c* and flows toward the ink tank 71. With this, the ink circulates between the head unit 3 and the ink tank 71.

The bypass channel 48 is formed by allowing through holes formed in the plates 23 to 25 to overlap with one another in the up-down direction. The bypass channel 48 extends in the conveyance direction, and communicate upper end parts of left-side end parts on the left side in the paper width direction of the three supplying manifolds 46 and upper end parts of left-side end parts on the left side in the paper width direction of the four returning manifolds 47 with one another. With this, each of the supplying manifolds 46 and the returning manifolds 47 has a part or portion which is located below the bypass channel 48. Further, the upper surface of the bypass channel 48 is also a curved surface 53 which is curved so as to convex upward. Furthermore, the curved surface 53 is a surface continued to the curved surfaces 51, 52*a* and 52*b*.

Further, as described above, in a case that the ink is circulated between the head unit 3 and the ink tank 71, the ink flows from the supplying manifolds 46 to the returning manifolds 47 also via the bypass channel 48.

Furthermore, in the first embodiment, the curved surfaces 51, 52*a*, 52*b* and 53 are formed by overlapping (stacking) the plates 23 to 25 with one another. Moreover, in the first embodiment, the through holes forming the supplying manifolds 46, the returning manifolds 47 and the bypass manifold 48 in the plates 23 to 25 are each formed by performing the etching to the plates 23 to 25 from therebelow. Here, the inner wall surface of each of the through holes formed by the etching is curved; by allowing the inner surfaces of the through holes formed in the plates 23 to 25 to continue to one another, the curved surfaces 51, 52*a*, 52*b* and 53 are formed.

Here, the plates 23 to 25 having the through holes for forming the curved surfaces 51, 52*a*, 52*b* and 53 each have a thickness in a range of approximately 0.05 mm to 0.1 mm With this, the total (sum) of the thicknesses of the plates 23 to 25 are made to be in a range of not less than 0.15 mm to not less than 0.3 mm, and which is greater than the height of the linking channel 43 (0.1 mm). The reason for making the thickness of each of the plates 23 to 25 to be not less than 0.05 mm is to ensure the handling property of the plates 23 to 25.

Further, a dumper chamber 56 which overlaps with each of the supplying manifolds 46 in the up-down direction and isolated from each of the supplying manifolds 46 is formed in the plate 29. Then, a partition wall formed of a lower end part of the plate 29 and isolating the supplying manifold 46 from the damper chamber 56 is deformed to thereby suppress any fluctuation in pressure in the ink inside each of the supplying manifolds 46. Furthermore, a dumper chamber 57 which overlaps with each of the returning manifolds 47 in the up-down direction and isolated from each of the returning manifolds 47 is formed in the plate 29. Then, a partition wall formed of a lower end part of the plate 29 and isolating the returning manifold 47 from the damper chamber 57 is deformed to thereby suppress any fluctuation in pressure in the ink inside each of the returning manifolds 47.

<Piezoelectric Actuator 12>

As depicted in FIGS. 2 to 6, the piezoelectric actuator 12 has two piezoelectric layers 61 and 62, a common electrode 63, and a plurality of individual electrodes 64. The piezoelectric layers 61 and 62 are each formed of a piezoelectric material of which main component is lead zirconate titanate (PZT) that is a mixed crystal of lead titanate and lead zirconate. The piezoelectric layer 61 is arranged on the upper surface of the channel unit 11, and the piezoelectric layer 62 is arranged on the upper surface of the piezoelectric layer 61. Note that, unlike the piezoelectric layer 62, the piezoelectric layer 61 may be formed of an insulating material including, for example, a synthetic resin material, which is different from the piezoelectric material.

The common electrode 63 is arranged between the piezoelectric layers 61 and 62, and extends continuously substantially over the entire areas of the piezoelectric layers 61 and 62. The common electrode 63 is maintained at the ground potential. The plurality of individual electrodes 64 are provided individually for the plurality of pressure chambers 40, respectively. Each of the individual electrodes 64 has a planar shape which is substantially rectangular and of which longitudinal direction is the conveyance direction; each of the individual electrodes 64 is arranged to be overlapped, in the up-down direction, with a central portion of one of the pressure chambers 40 corresponding thereto. Further, an end part, of each of the individual electrodes 64, on the opposite side to the descender channel 42 in the conveyance direction extends up to a position not overlapping with the pressure chamber 40, and a forward (tip) end part of the end part is a contact terminal 64*a* for performing connection with respect to an unillustrated wiring material. Contact terminals 64*a* of the plurality of individual electrodes 64 are connected to an unillustrated driver IC via the unillustrated wiring material. Further, any one of the ground potential and a predetermined driving potential (for example, about 20V) is selectively applied by the driver IC individually to each of the plurality of individual electrodes 64. Furthermore, in correspondence to the arrangement of the common electrode 63 and the plurality of individual electrodes 64 in the above-described manner, a part or portion, of the piezoelectric layer 62, which is sandwiched between the common electrode 63 and each of the individual electrodes 64 is an active part or portion which is polarized in the thickness direction thereof.

Here, an explanation will be given about a method of driving the piezoelectric actuator 12 to thereby jet (discharge) the ink from the nozzles 45. In the piezoelectric actuator 12, in a stand-by state in which the ink is not jetted from the nozzles 45, all of the individual electrodes 64 are maintained at the ground potential which is same as in the common electrode 63. In a case that the ink is to be jetted from a certain nozzle 45, among the nozzles 45, the potential of two individual electrodes 64, included in the individual electrodes 64 and corresponding to two pressure chambers 40 connected to the certain nozzle 45, is switched from the ground potential to the driving potential.

This generates an electric field parallel to the polarization direction in two active parts corresponding to the two individual electrodes 64, which in turn causes the two active parts to contract in the horizontal direction orthogonal to the polarization direction. This causes the parts of the piezoelectric layers 61 and 62 which overlap with the two pressure chambers 40 in the up-down direction to be deformed so as to project (convex), as a whole, toward the pressure chambers 40. As a result, the volume of the two pressure chambers 40 is decreased to thereby increase the pressure of the ink inside the pressure chambers 40, causing the ink to be jetted from the certain nozzle 45 communicating with the pressure chambers 40. Further, after the ink is jetted from the certain nozzle 45, the potential of the two individual electrodes 64 is returned to the ground potential. With this, the states of the piezoelectric layers 61 and 62 return to the states before the deformation.

In the head unit 3 of the first embodiment, any air bubble flows from the nozzles 45 into the individual channel 38, in some cases. In a case that the air bubble is present in the inside of the individual channel 38, there is such a fear that the jetting characteristic (discharging characteristic) of the ink from the nozzle 45, in the case that the piezoelectric actuator 12 is driven, might be changed or fluctuated. In view of such a possibility, in the first embodiment, the ink is circulated between the head unit 3 and the ink tank 71 to thereby discharge any air bubble in the inside of the individual channel 38 to the returning manifold 47.

Here, in the first embodiment, the air bubble discharged to the returning manifold 47 remains at the upper end part of the returning manifold 47. On the other hand, the connecting part 50 with respect to the individual channel 38 (throttle channel 41) is provided on the upper surface of the returning manifold 47.

In the first embodiment, however, with respect to the configuration wherein the connecting parts 50 with respect to the individual channels 38 (throttle channels 41) are provided respectively on the both end parts in the conveyance direction, in the upper surface of each of the returning manifolds 47*a*, the upper surface of the returning manifold 47*a* is the curved surface 52*a* having a convex shape which is, as projected in the paper width direction, convex upward. Further, the highest point (summit) of the curved surface 52*a* is located at the central part in the conveyance direction of the curved surface 52*a* which is separated from the connecting part 50 with respect to any one of the individual channels 38 as far as possible. With this, any air bubble in the inside of the returning manifold 47*a* easily remains at a part or portion in the vicinity of the highest point of the curved surface 52*a* which is separated from the connecting part 50 with respect to any one of the individual channels 38 as far as possible, thereby making it possible to prevent the air bubble from flowing backward from the returning manifold 47*a* into the individual channel 38.

Here, the diameter of the air bubble flowing from the nozzle 45 into the linking channel 43 is not more than the height of the linking channel 43 (approximately 0.1 mm). In contrast, the height of the part defined by the curved surface 52*a*, 52*b* in the upper end part of the returning manifold 47*a*, 47*b* (the sum of the thicknesses of the plates 23 to 25) is approximately in a range of 0.15 mm to 0.3 mm. Accordingly, the height of the part defined by the curved surface 52*a*, 52*b* in the upper end part of the returning manifold 47*a*, 47*b* is greater than the maximum diameter of the air bubble inside the returning manifold 47*a*, 47*b*, and thus the air bubble inside the returning manifold 47*a*, 47*b* does not easily flow backward to the connecting part 50.

Further, in the returning manifold 47*a*, the distance from the highest point in the conveyance direction of the curved surface 51 to a part or portion, of the connecting part 50 closer to the center of the curved surface 52*a* is approximately in a range of 0.5 mm to 0.6 mm; this distance is greater than half the maximum diameter (0.05 mm which is half of 0.1 mm) of the air bubble flowing from the nozzle 45 into the linking channel 43. Accordingly, the air bubble inside the returning manifold 47*a*, 47*b* does not easily flow backward from the connecting part 50 to the individual channel 38.

Further, in the first embodiment, with respect to the configuration wherein the connecting parts 50 with respect to the individual channels 38 are provided on the end part on one side in the conveyance direction of the upper surface of each of the returning manifolds 47*b*, the upper surface of the returning manifold 47*b* is the curved surface 52*b* and the highest point (summit) of the curved surface 52*b* is located at an end part on the other side in the conveyance direction of the curved surface 52*b* which is on the opposite side to the connecting parts 50 with respect to each of the individual channels 38 respectively. With this, any air bubble in the inside of the returning manifold 47*b* easily remains at a part or portion in the vicinity of the highest point of the curved surface 52*a* which is separated from the connecting parts 50 with respect to the individual channels 38 as far as possible, thereby making it possible to prevent the air bubble in the inside of the returning manifold 47*b* from flowing backward from the returning manifold 47*b* into the individual channels 38.

Furthermore, in the first embodiment, the curved surface 52*a*, 52*b* extends up to the part, of the returning manifold 47*a*, 47*b*, at which the discharge port 47*c* is formed, as depicted in FIGS. 7B and 7C. Accordingly, the air bubble inside the returning manifold 47*a*, 47*b* is easily discharged from the discharge port 47*c*.

In the first embodiment, with respect to the configuration wherein the connecting parts 49 with respect to the individual channels 38 are provided respectively on both end parts in the conveyance direction of the upper surface of each of the supplying manifolds 46, the upper surface of the supplying manifold 46 is the curved surface 51 having a convex shape which is, as projected in the paper width direction, convex upward; the highest point (summit) of the curved surface 51 is located at the central part in the conveyance direction of the curved surface 51. With this, any air bubble in the inside of the supplying manifold 46 easily remains at a part or portion in the vicinity of the highest point of the curved surface 51 which is separated from the connecting part 46 with respect to any one of the individual channels 38 as far as possible, thereby making it possible to prevent the air bubble in the inside of the supplying manifold 46 from flowing from the connecting part 49 into the individual channel 38 in a case that the ink flows into the supplying manifold 46 into the individual channel 38.

Further, in the first embodiment, the curved surface 51 extends up to the part, of the supplying manifold 46, at which the supply port 46*a* is formed, as depicted in FIG. 7A. Accordingly, the air bubble flowing from the supply port 46*a* into the supplying manifold 46 does not easily flow into the individual channel 38, but easily flows into the bypass channel 48.

Furthermore, the first embodiment has the configuration wherein the supply port 46*a* is provided on the right-side end part in the paper width direction of the supplying manifold 46, and the discharge port 47*c* is provided on the right-side end part in the paper width direction of the returning manifold 47. Regarding this configuration, in the first embodiment, the upper end parts of the left-side end parts in the paper width direction of the three supplying manifolds 46 and the upper end parts of the left-side end parts in the paper width direction of the four returning manifolds 47 are connected with one another by the bypass channel 48. With this, the air bubble in the inside the supply manifolds 46 flows into the returning manifolds 47 via the bypass channel 48, thereby preventing the air bubble from remaining in the inside of the supplying manifolds 46.

Moreover, regarding the situation (tendency) that the air bubble easily remains in an upper end part of a channel, the first embodiment is provided with such a configuration that the upper end parts of the left-side end parts in the paper width direction of the three supplying manifolds 46 and the upper end parts of the left-side end parts in the paper width direction of the four returning manifolds 47 are connected with one another by the bypass channel 48. With this, as compared with such a case that parts or portions which are different from the upper end parts of the left-side end parts in the paper width direction of the three supplying manifolds 46, and parts or portions which are different from the upper end parts of the left-side end parts in the paper width direction of the four returning manifolds 47 are connected to one another by the bypass channel 48, the air bubble does not easily remain in the connecting parts between the supplying manifolds 46 and the bypass channel 48 and in the connecting parts between the returning manifolds 47 and the bypass channel 48, and the air bubble in the inside of the supplying manifolds 46 easily flows into the returning manifolds 47 via the bypass channel 48.

Here, if the channel resistance (flow resistance) in the bypass channel 48 is small, in a case that the ink is circulated between the head unit 3 and the ink tank 71, a flow of the ink is easily generated from the supplying manifolds 46 to the returning manifolds 47 via the bypass channel 48; due to such a flow of the ink, a flow of the ink is not easily generated from the supplying manifolds 46 to the returning manifolds 47 via the individual channels 38. In the first embodiment, as described above, the upper end parts of the left-side end parts in the paper width direction of the three supplying manifolds 46 and the upper end parts of the left-side end parts in the paper width direction of the four returning manifolds 47 are connected with one another by the bypass channel 48; and thus each of the supplying manifolds 46 and the returning manifolds 47 has a part or portion which is located below the bypass channel 48. With this, it is possible to make the channel resistance in the bypass channel 48 to be greater, as compared with such a case that the bypass channel 48 is provided to extend over the entire lengths in the up-down direction of the supplying manifolds 46 and the returning manifolds 47.

Further, in the first embodiment, the upper surface of the bypass channel 48 is the curved surface 53, and the curved surfaces 51, 52*a*, 52*b* and 53 are configured to form a continuous surface. With this, any air bubble is not easily caught at a boundary part between the curved surfaces 51, 52*a* and 52*b* and the curved surface 53, and thus allows the air bubble in the inside of the supplying manifolds 46 to easily flow into the returning manifolds 47 via the bypass channel 48.

Further, the above-described curved surfaces 51, 52*a*, 52*b* and 53 can be formed by stacking the plurality of plates which are formed with through holes which have different shapes as projected in the up-down direction. Furthermore, in a case that the curved surfaces 51, 52*a*, 52*b* and 53 are to be formed by stacking the plurality of plates formed with the through holes, it is possible to make the steps for forming the curved surfaces 51, 52*a*, 52*b* and 53 to be easier than, for example, in such a case of forming a curved surface in one plate having a great thickness.

Second Embodiment

Next, an explanation will be given about a second embodiment of the present disclosure. In the second embodiment, as depicted in FIGS. 9 to 12, a head unit 101 (corresponding to a "liquid discharge head" of the present disclosure) is provided with a channel unit 111 and a piezoelectric actuator 112.

<Channel Unit 111>

The channel unit 111 is formed of 9 pieces of plates 120 to 128 which are stacked from the upper side in this order. The channel unit 111 is formed with a plurality of pressure chambers 140, a plurality of throttle channels 141 (corresponding to a "second connecting channel" of the present disclosure), a plurality of descender channels 142 (corresponding to a "communicating passage" of the present disclosure), a plurality of linking channels 143 (corresponding to a "first connecting channel" of the present disclosure), a plurality of nozzles 145, two supplying manifold 146 (corresponding to a "inflow channel" of the present disclosure), and one returning manifold 147 (corresponding to an "outflow channel" of the present disclosure).

The plurality of pressure chambers 140 are formed in the plate 120. Each of the pressure chambers 140 has a planar shape which is similar to that of the pressure chamber 40. Further, the plurality of pressure chambers 140 are arranged side by side in the paper width direction to thereby form a pressure chamber row 139; in the plate 120, two pieces of the pressure chamber row 139 are arranged side by side in the conveyance direction. Moreover, among the two pressure chamber rows 139, the positions in the paper width direction of the pressure chambers 140 are shifted from each other.

The plurality of throttle channels 141 are formed to span across the plates 121 and 122. Each of the plurality of throttle channels 141 is provided individually on one of the plurality of pressure chambers 140. A throttle channel 141, included in the plurality of throttle channels 141 and corresponding to a pressure chamber 140 constructing a pressure chamber row 139 on the upstream side in the conveyance direction, is connected to an end part on the downstream side in the conveyance direction of the pressure chamber 140, and is extended from a connecting part with respect to the pressure chamber 140 toward the downstream side in the conveyance direction. A throttle channel 141, included in the plurality of throttle channels 141 and corresponding to a pressure chamber 140 constructing a pressure chamber row 139 on the downstream side in the conveyance direction, is connected to an end part on the upstream side in the conveyance direction of the pressure chamber 140, and is extended from a connecting part with respect to the pressure chamber 140 toward the upstream side in the conveyance direction.

The plurality of descender channels 142 are formed by allowing through holes formed in the plates 121 to 127, respectively, to overlap with one another in the up-down direction. Each of the plurality of descender channels 142 is provided individually on one of the plurality of pressure chambers 140. A certain descender channel 142, included in the plurality of descender channels 142 is connected to an end part on the opposite side to the throttle channel 141 in the conveyance direction of a pressure chamber 140, included in the plurality of pressure chambers 140 and corresponding to the certain descender channel 142. The descender channel 142 is extended downward from a connecting part with respect to the pressure chamber 140. The plurality of linking channels 143 are formed in the plate 127.

Each of the plurality of linking channels 143 is provided individually on one of the plurality of descender channels 142. A linking channel 143 included in the plurality of linking channels 143 and corresponding to a pressure chamber 140 constructing a pressure chamber row 139 included in the pressure chamber rows 139 and arranged on the upstream side in the conveyance direction is connected to a lower end part of the descender channel 142; and the linking channel 143 extends toward the upstream side in the conveyance direction from a connecting part with respect to the descender channel 142. A linking channel 143 included in the plurality of linking channels 143 and corresponding to a pressure chamber 140 constructing a pressure chamber row 139 included in the pressure chamber rows 139 and arranged on the downstream side in the conveyance direction is connected to a lower end part of the descender channel 142; and the linking channel 143 extends toward the downstream side in the conveyance direction from a connecting part with respect to the descender channel 142.

The plurality of nozzles 145 are formed in the plate 128. Each of the plurality of nozzles 145 is provided individually on one of the plurality of descender channels 142, and overlaps with one of the plurality of descender channels 142 in the up-down direction.

Further, the channel unit 111 is formed with a plurality of individual channels 138 each having one nozzle 145, one descender channel 142 connected to the one nozzle 45, one pressure chamber 140 connected to the one descender channel 142, one throttle channel 141 connected to the one pressure chamber 140, and one linking channel 143 connected to the one descender channel 142. The plurality of individual channels 138 are aligned in the paper-width direction so as to form an individual channel row 137. Furthermore, in the channel unit 111, two pieces of the individual channel row 137 are arranged side by side along the conveyance direction.

The two supplying manifolds 146 are each formed by allowing through holes formed in the plates 126 and 127, respectively, to overlap with each other in the up-down direction. The two supplying manifolds 146 each extend in the paper width direction, and are arranged on the both sides in the conveyance direction of the two individual channel rows 137. The two supplying manifolds 146 correspond to the two individual channel rows 137, respectively; each of the two supplying manifolds 146 is connected to end parts on the opposite side to the descender channels 142 of the linking channels 143 of the individual channels 138 constructing one of the individual channel rows 137 which corresponds to each of the two supplying manifolds 146.

The returning manifold 147 is formed by allowing through holes formed in the plates 123 to 127, respectively, to overlap with each other in the up-down direction. The returning manifold 147 extends in the paper width direction, and is arranged between the two supplying manifolds 146 in the conveyance direction. The returning manifold 147 is connected to end parts, of the throttle channels 141, on the opposite side to the pressure chambers 140.

To provide a more detailed explanation, connecting parts 150 with respect to (connected respectively to) the throttle channels 141, corresponding to a pressure chamber row 139 included in the above-described two pressure chamber rows 139 and which is located on the downstream side in the conveyance direction, are provided on an end part on the upstream side in the conveyance direction of the upper surface of the returning manifold 147. Furthermore, connecting parts 150 connected respectively to the throttle channels 141, corresponding to a pressure chamber row 139 included in the above-described two pressure chamber rows 139 and which is located on the upstream side in the conveyance direction, are provided on an end part on the downstream side in the conveyance direction of the upper surface of the returning manifold 147. Namely, the connecting parts 150 connected respectively to the throttle channels 141 are provided on the both end parts in the conveyance direction of the upper surface of the returning manifold 147.

Figure 11A:
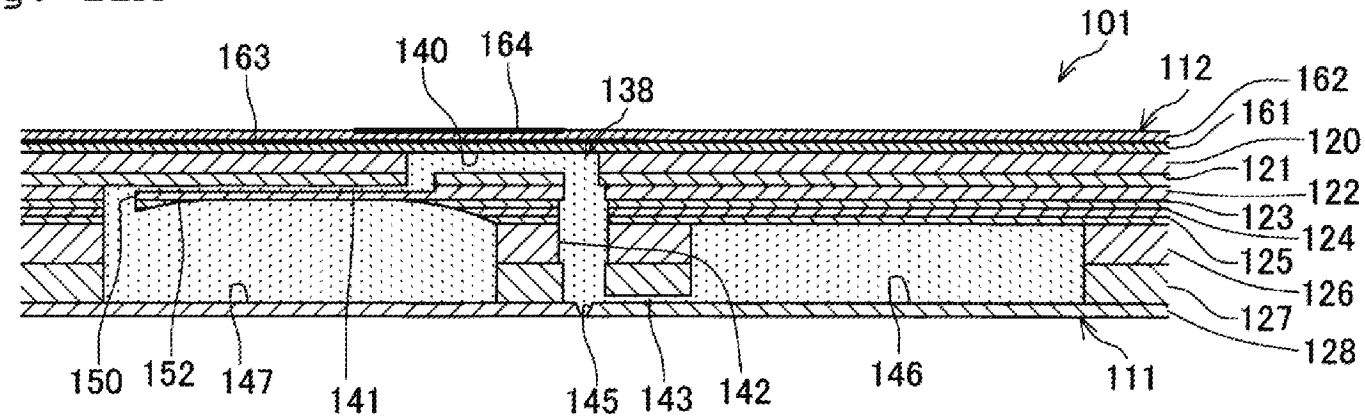
FIG. 11A is a cross-sectional view taken along a line XIA-XIA in FIG. 10.
Figure 11B:
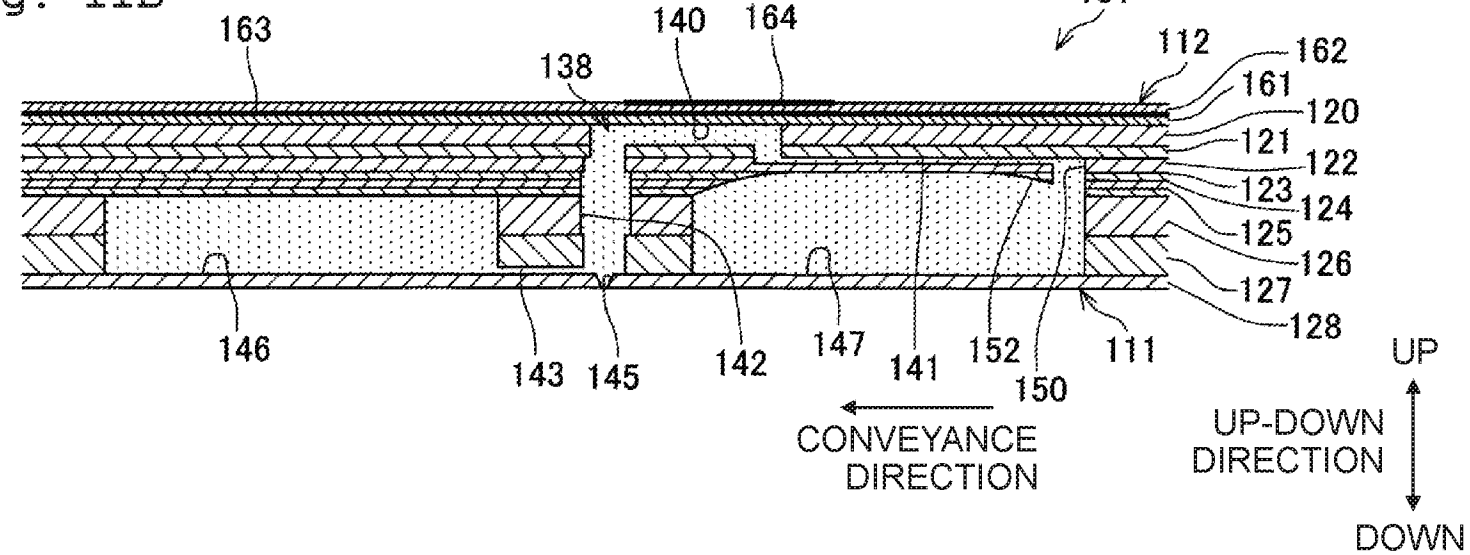
FIG. 11B is a cross-sectional view taken along a line XIB-XIB in FIG. 10.
Figure 12:
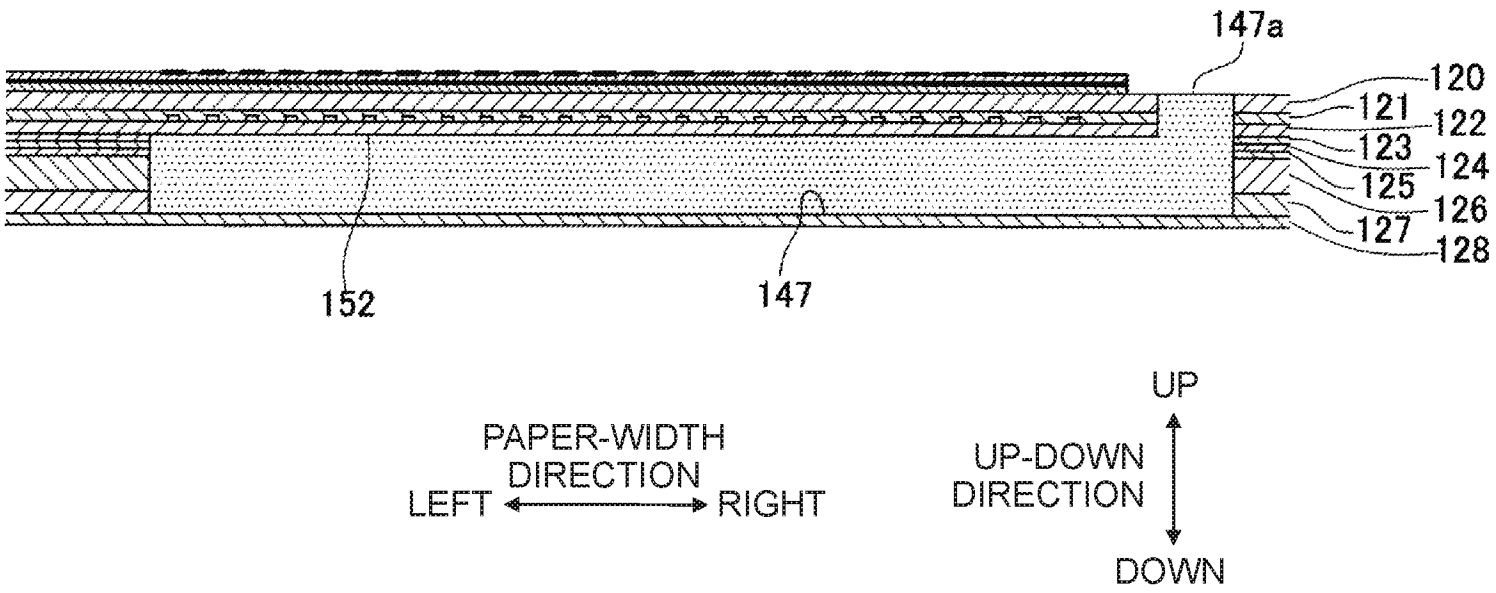
FIG. 12 is a cross-sectional view taken along a line XII-XII in FIG. 9.

With respect to the above-described configuration, in the second embodiment, the upper surface of the returning manifold 147 is a curved surface 152 having a shape which is, as projected in the paper width direction, convex upward (corresponding to a "convex part" of the present disclosure), as depicted in FIGS. 11A and 11B. Moreover, the highest point (summit) of the curved surface 152 is located in a central part in the conveying direction of the curved surface 152. Further, as depicted in FIG. 12, the curved surface 152 extends over the entire length in the paper width direction of the returning manifold 147, including a part or portion of the returning manifold 147 formed with the connecting part 150 with respect to the individual channels 138 and a part formed with a discharge port 147*a*.

Note that the upper surface of each of the two supplying manifolds 146 is a plane (flat surface) parallel to the paper width direction and the conveyance direction. Further, the channel unit 111 of the second embodiment is not provided with a bypass channel connecting left-side end parts on the left side in the paper width direction of the supplying manifolds 146 and a left-side end part on the left side in the paper width direction of the returning manifold 147.

Further, each of the supplying manifolds 146 extends in the up-down direction across the plates 120 to 127 at a right-side end part thereof in the paper width direction, and a supply port 146*a* is provided on an upper end part of the right-side end part. Two supply ports 146*a* of the two supplying manifolds 146 are communicated with each other, and are connected to an ink tank 171 via a pump 172 for circulation (circulating pump 172). The ink tank 171 is connected to an unillustrated ink cartridge via an unillustrated tube, etc., and the ink is supplied from the ink cartridge to the ink tank 171.

Furthermore, the returning manifolds 147 extends in the up-down direction across the plates 121 to 127 at a right-side end part thereof in the paper width direction, and a discharge port 147*a* is provided on an upper end part of the right-side end part. The discharge port 147*a* is connected to the ink tank 171.

In a case that the circulating pump 172 is driven, the ink inside the ink tank 171 flows from the supply ports 146*a* into the supplying manifolds 146. Further, the ink flows from the supplying manifolds 146 into the plurality of individual channels 138, and the ink flows from the plurality of individual channels 138 into the returning manifold 147. Furthermore, the ink inside the returning manifold 147 flows out from the discharge port 147*a* and flows toward the ink tank 171. With this, the ink circulates between the head unit 101 and the ink tank 171.

<Piezoelectric Actuator 112>

The piezoelectric actuator 112 has two piezoelectric layers 161 and 162, a common electrode 163, and a plurality of individual electrodes 164. The piezoelectric layers 161 and 162 are each formed of a piezoelectric material. The piezoelectric layer 161 is arranged on the upper surface of the channel unit 111, and the piezoelectric layer 162 is arranged on the upper surface of the piezoelectric layer 161.

The common electrode 163 is arranged between the piezoelectric layers 161 and 162, and extends continuously substantially over the entire areas of the piezoelectric layers 161 and 162. The plurality of individual electrodes 164 are provided individually for the plurality of pressure chambers 140, respectively. Each of the individual electrodes 164 has a planar shape which is substantially rectangular and of which longitudinal direction is the conveyance direction; each of the individual electrodes 164 is arranged to be overlapped, in the up-down direction, with a central portion of one of the pressure chambers 140 corresponding thereto.

In the second embodiment, with respect to the configuration wherein the connecting parts 150 with respect to the individual channels 138 (throttle channel 141) are provided respectively on both end parts in the conveyance direction of the upper surface of the returning manifold 147, the upper surface of the returning manifold 147 is the curved surface 152 having a convex shape which is, as projected in the paper width direction, convex upward. Further, the highest point (summit) of the curved surface 152 is located at the central part in the conveyance direction of the curved surface 152. With this, any air bubble in the inside of the returning manifold 147 easily remains at a part or portion in the vicinity of the highest point of the curved surface 152 which is separated from the connecting part 150 with respect to any one of the individual channels 138 as far as possible, thereby making it possible to prevent the air bubble from flowing backward from the returning manifold 147 into the individual channel 138.

Here, in the second embodiment, the connecting parts with respect to the linking channels 143 are provided on the lower end parts of the supplying manifolds 146. Accordingly, such a situation does not easily occur that any air bubble remaining at an upper end part of each of the supplying manifolds 146 flows from the linking channel 143 into the individual channel 138. Thus, in the second embodiment, the upper surface of the returning manifold 147 is made to be the curved surface 152, whereas the upper surface of the supplying manifold 146 is made to be a plane, rather than a curved surface.

Further, in the second embodiment, the curved surface 152 extends up to a part, of the returning manifold 147, at which the discharge port 147*a* is formed, as depicted in FIG. 12. Accordingly, the air bubble inside the returning manifold 147 is easily discharged from the discharge port 147*a*.

Furthermore, also in the second embodiment, the above-described curved surface 152 can be formed by stacking the plurality of plates which are formed with through holes which have different shapes as projected in the up-down direction.

Although the first and second embodiments of the present disclosure have been explained in the foregoing, the present disclosure is not limited to or restricted by the first and second embodiments; rather, various kinds of changes may be made on the present disclosure, within the scope of the claims.

In the first embodiment, the curved surface 51 of the supplying manifold 46, the curved surface 52*a*, 52*b* of the returning manifold 47 and the curved surface 53 of the bypass channel 48 are all located at a same height. The present disclosure, however, is not limited or restricted by this configuration.

Figure 13A:
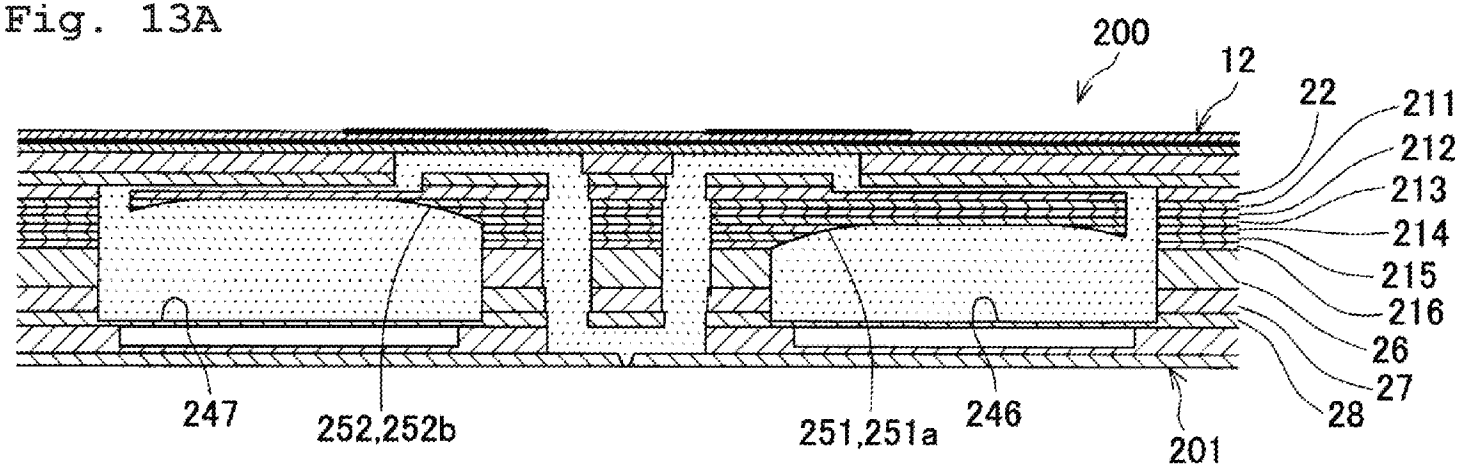
FIG. 13A is a view of a head unit 200 of a first modification, corresponding to FIG. 4A in view of a part on the right side in a paper width direction.
Figure 13B:
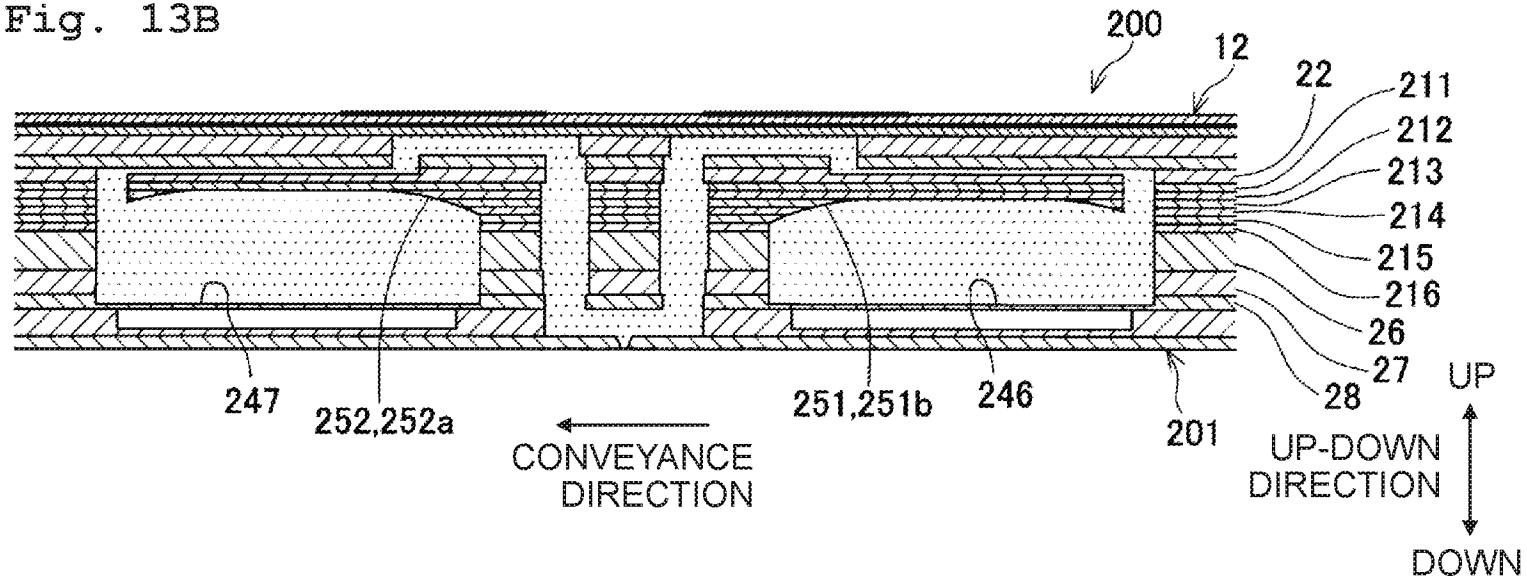
FIG. 13B is a view of the head unit 200 of the first modification, corresponding to FIG. 4A in view of a part on the left side in the paper width direction.
Figure 14:
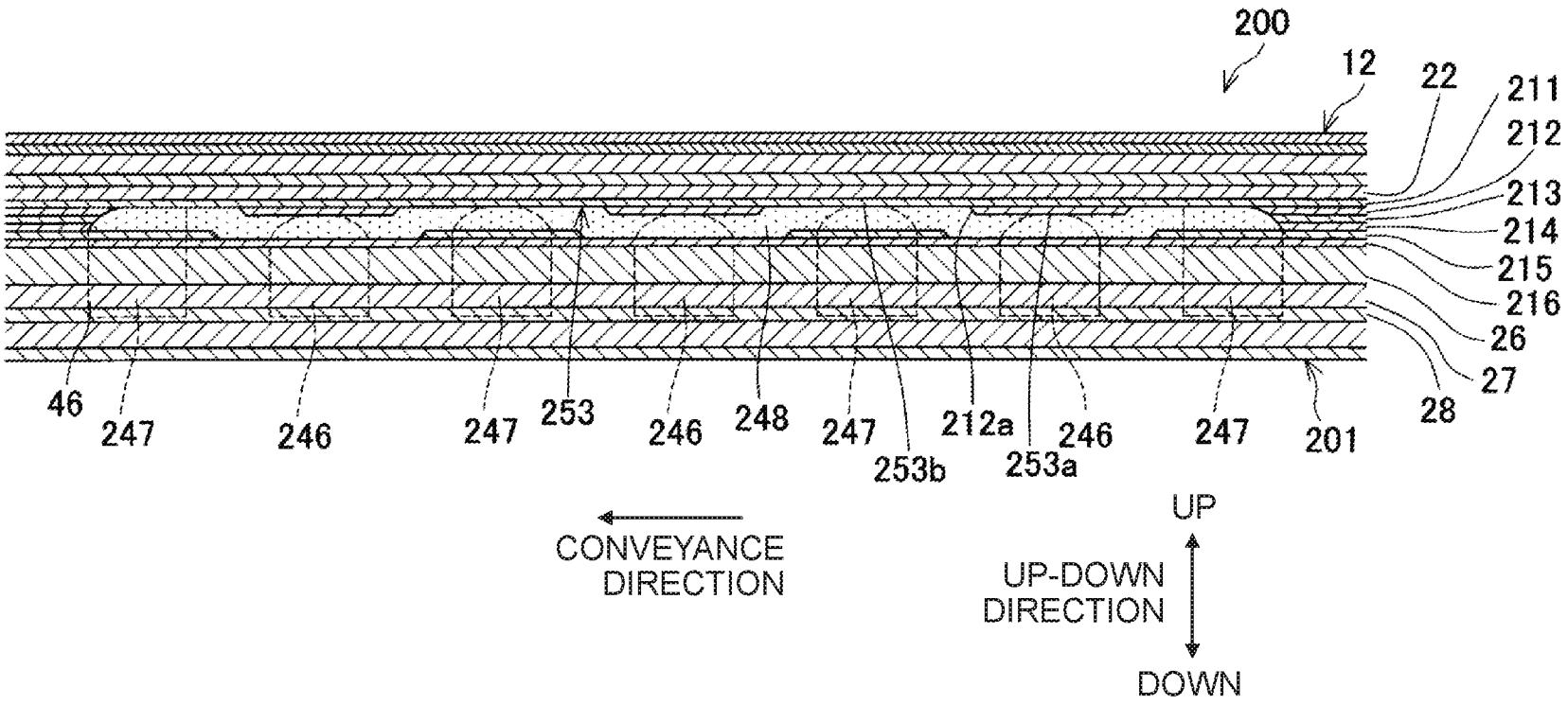
FIG. 14 is a cross-sectional view of a bypass channel 248, of the head unit 200 of the first modification, along a conveyance direction.

In a first modification, as depicted in FIGS. 13 to 15, a head unit 200 is provided with a channel unit 201 wherein 6 pieces of plates which are stacked plates 211 to 216 replace the three plates 23 to 25 stacked in the channel unit 11 of the above-described embodiment.

Further, in the first modification, substantially a half of a right-side part on the right side in the paper width direction of a supplying manifold 246 is formed by allowing through holes formed in the plates 214 to 216, 26 and 27 to overlap with a recessed part formed in the plate 28. Further, among these plates, the three plates 214 to 216 forms a right-side part 251*a* on the right side in the paper width direction of a curved surface 251 which is the upper surface of the supplying manifold 246.

Further, substantially a half of a left-side part on the left side in the paper width direction of the supplying manifold 246 and a part including a connecting part, of the bypass channel 248, with respect to the supplying manifold 246 are formed by allowing through holes formed in the plates 213 to 216, 26 and 27 to overlap with a recessed part formed in the plate 28. Further, among these plates, the three plates 213 to 215 form a left-side part 251*b* on the left side in the paper width direction of the curved surface 251 which is the upper surface of the supplying manifold 246, and form a supply-side part 253*a* included in the curved surface 253 as the upper surface of the bypass channel 248 and including a connecting part with respect to the supplying manifold 246.

Further, substantially a half of a left-side part on the left side in the paper width direction of the returning manifold 247 and a part including a connecting part, of the bypass channel 248, with respect to the returning manifold 247 are formed by allowing through holes formed in the plates 212 to 216, 26 and 27 to overlap with a recessed part formed in the plate 28. Furthermore, among these plates, the three plates 212 to 214 form a left-side part 252*a* on the left side in the paper width direction of the curved surface 252 which is the upper surface of the returning manifold 247, and form a return-side part 253*b* included in the curved surface 253 as the upper surface of the bypass channel 248 and including a connecting part with respect to the returning manifold 247.

Moreover, substantially a half of a right-side part on the right in the paper width direction of the returning manifold 247 is formed by allowing through holes formed in the plates 211 to 216, 26 and 27 to overlap with a recessed part formed in the plate 28. Further, among these plates, the three plates 211 to 213 form a right-side part 252*b* on the right side in the paper width direction of the curved surface 252 which is the upper surface of the returning manifold 247.

From these configurations, in the first modification, the left-side part 251*b* in the paper width direction of the curved surface 251 of the supply manifold 246 is located at a position above the right-side part 251*a* in the paper width direction of the curved surface 251. Namely, the curved surface 251 of the supplying manifold 246 is arranged such that the curved surface 251 is located at an upper position as approaching more closely to (more closely toward) the left side in the paper width direction.

Further, the curved surface 253 of the bypass channel 248 is located, at the return-side part 253*b*, at a position above the supply-side part 253*a*. Namely, the curved surface 253 of the bypass channel 248 is arranged such that the curved surface 253 is located at an upper position as approaching more closely from the connecting part with respect to the supplying manifold 246 to (toward) the connecting part with respect to the returning manifold 247.

The curved surface 252 of the returning manifold 247 is located, at the right-side part 252*b* in the paper width direction, at a position above the left-side part 252*a* in the paper width direction. Namely, the curved surface 252 of the returning manifold 247 is arranged such that the curved surface 252 is located at an upper position as approaching more closely to (toward) the right side in the paper width direction (toward a discharge port 247 which will be described later on).

Further, also in the first modification, the through holes defining the supplying manifold 246 in the plates 211 to 216 and the through holes defining the returning manifold 247 and the bypass channel 248 in the plates 211 to 216 are each formed by performing the etching to the plates 211 to 216; the inner wall surface of each of the through holes is formed to be an inclined surface inclined with respect to the up-down direction.

Figure 15A:
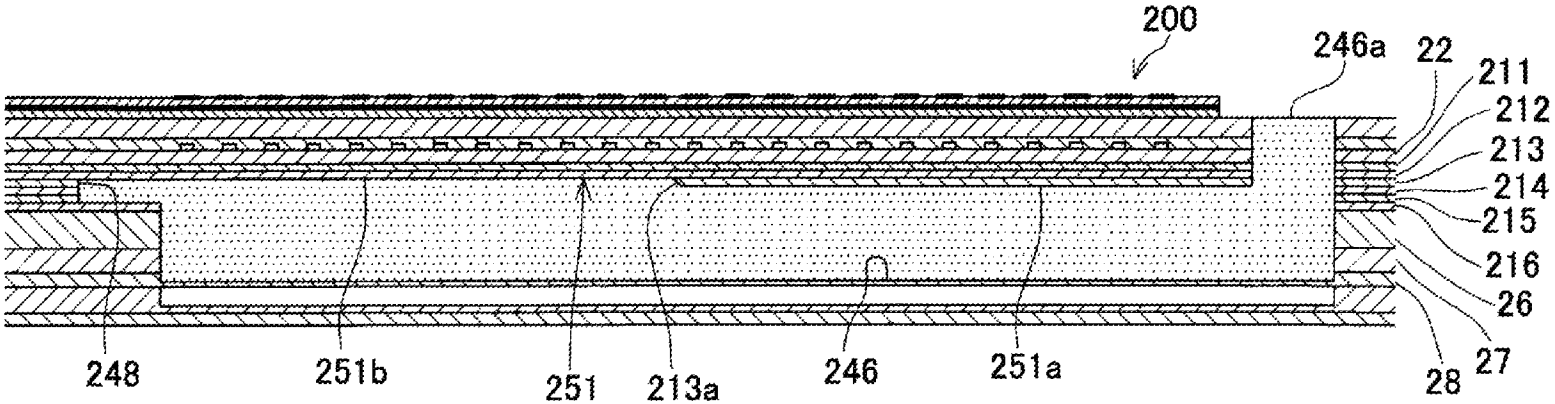
FIG. 15A is a cross-sectional view of a supplying manifold 246 of the head unit 200 of the first modification, along the paper width direction.

With this, as depicted in FIG. 15A, the part 251*a* and the part 251*b* of the curved surface 251 of the supplying manifold 246 are smoothly connected via an inner wall surface 213*a* which is inclined with respect to the vertical direction of a through hole formed in the plate 213. Here, the inclination angle of the inner wall surface 213*a* with respect to the vertical direction is approximately in a range of 30 degrees to 45 degrees. In a case that the inclination angle of the inner wall surface 213*a* is within this range, it is possible to prevent the air bubble from flowing backward from the part 251*b* on the left side of the curved surface 251 toward the part 251*a* on the right side of the curved surface 251. Note that such a phrase that "surfaces are smoothly connected" indicate a situation or state wherein a surface and another surface are connected to each other continuously at a connecting part thereof, and that there is no sharp or pointed part (corner part or apex) in the connecting part at which the surfaces are connected to each other.

Further, as depicted in FIG. 14, the part 253*a* and the part 253*b* of the curved surface 253 of the bypass channel 248 are smoothly connected via an inner wall surface 212*a* which is inclined with respect to the vertical direction of a through hole formed in the plate 212. Here, the inclination angle of the inner wall surface 212*a* with respect to the vertical direction is approximately in a range of 30 degrees to 45 degrees. In a case that the inclination angle of the inner wall surface 212*a* is within this range, it is possible to prevent the air bubble from flowing backward from the part 253*b* on the return side of the curved surface 253 toward the part 253*a* on the supply side of the curved surface 253.

Figure 15B:
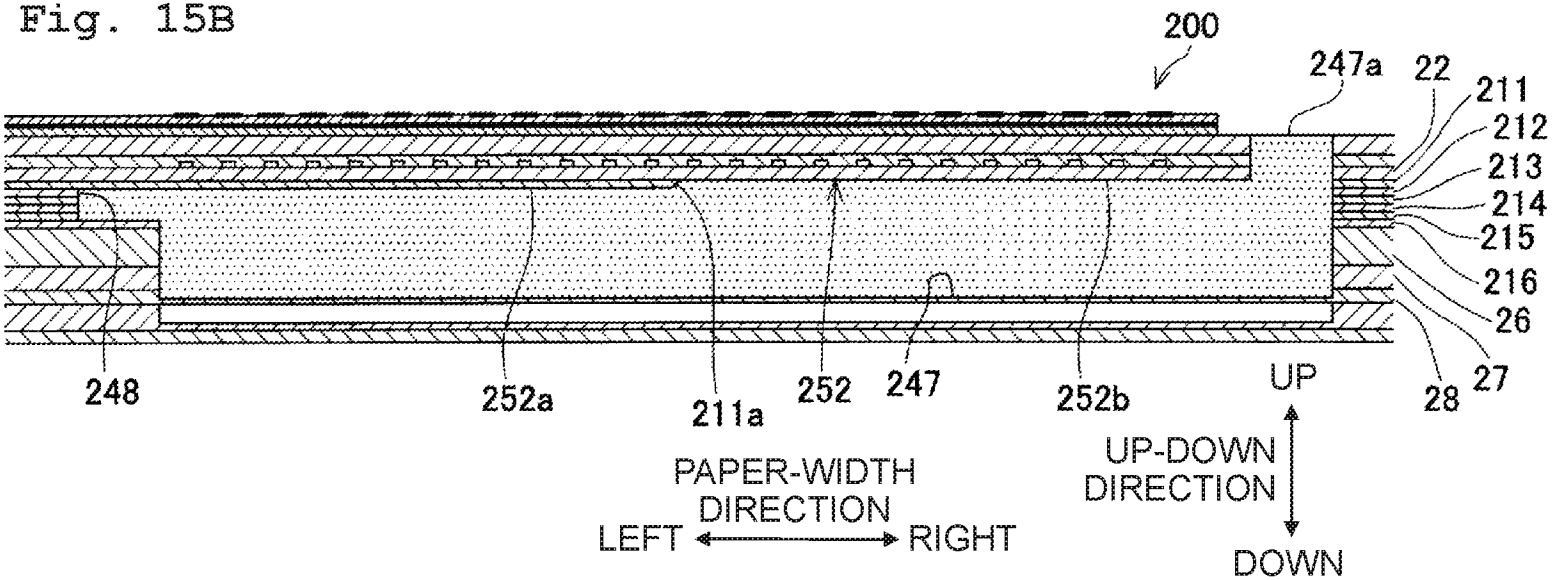
FIG. 15B is a cross-sectional view of a returning manifold 247 of the head unit 200 of the first modification, along the paper width direction.

Furthermore, as depicted in FIG. 15B, the part 252*a* and the part 252*b* of the curved surface 252 of the returning manifold 247 are smoothly connected via an inner wall surface 211*a* which is inclined with respect to the vertical direction of a through hole formed in the plate 211. Here, the inclination angle of the inner wall surface 211*a* with respect to the vertical direction is approximately in a range of 30 degrees to 45 degrees. In a case that the inclination angle of the inner wall surface 211*a* is within this range, it is possible to prevent the air bubble from flowing backward from the part 252*b* on the right side of the curved surface 252 toward the part 252*a* on the left side of the curved surface 252.

Moreover, a right-side end part on the right sight in the paper width direction of the supplying manifold 246 extends in the up-down direction across the plates 211 to 216; and a supply port 246*a* is formed at an upper end part of the right-side end part. Further, a right-side end part on the right sight in the paper width direction of the returning manifold 247 extends in the up-down direction across the plates 211 to 216; and a discharge port 247*a* is formed at an upper end part of the right-side end part.

In the first modification, the left-side part 251*b* in the paper width direction is located above (over) the right-side part 251*a* in the paper width direction in the curved surface 251 which is the upper surface of the supplying manifold 246. With this, an air bubble in the inside of the supplying manifold 246 easily flows from the right side toward the left side in the paper width direction (toward the bypass channel 248).

Further in the first modification, the return-side part 253*b* is located above (over) the supply-side part 253*a* in the curved surface 253 which is the upper surface of the bypass channel 248. With this, an air bubble flowing from the supplying manifold 246 into the bypass channel 248 easily flows toward the returning manifold 247.

Furthermore in the first modification, the right-side part 252*b* in the paper width direction is located above (over) the left-side part 252*a* in the paper width direction in the curved surface 252 which is the upper surface of the returning manifold 247. With this, an air bubble in the inside of the returning manifold 247 easily flows from the left side toward the right side in the paper width direction (toward the discharge port 247*a*).

Moreover in the first modification, although the height of the curved surface as the upper surface of each of the supplying manifold 246, the returning manifold 247 and the bypass channel 248 is changed in the two-step manner, there is no limitation to this. It is allowable to change the height of the curved surface 251 of the supplying manifold 246 in not less than three steps such that the curved surface 251 is located at an upper position as approaching more closely to the left side in the paper width direction. Similarly, it is allowable to change the height of the curved surface 253 of the bypass channel 248 such that the curved surface 253 is located at an upper position as approaching more closely from the connecting part with respect to the supplying manifold 246 toward the connecting part with respect to the returning manifold 247.

Further in the first modification, although the height of the upper surface is changed depending on the portion of each of the curved surface 251 of the supplying manifold 246, the curved surface 252 of the returning manifold 247 and the curved surface 253 of the bypass channel 248, there is no limitation to this. It is allowable to change the height at (depending on) a part, as described above, regarding only a part of the curved surfaces 251, 252 and 253.

Furthermore in the first modification, the entirety of the upper surface of the curved surface 251 is located at an upper position as approaching closely to the left side in the paper width direction, it is allowable that at least a highest point (summit) in the upper surface of the curved surface 251 is located at an upper position as approaching in the first direction more closely toward the left side in the paper width direction. This is applicable similarly also to the curved surfaces 252 and 253.

Moreover, also in the second embodiment, it is allowable to change the height of the curved surface 152 as the upper surface of the returning manifold 147, in a similar manner regarding the returning manifold 247 of the first modification, such that the curved surface 152 is located at an upper position as approaching more closely toward the left side in the paper width direction.

Further, in the first embodiment, although the curved surface 51 extends across the entire length in the paper width direction of the supplying manifold 246, and the curved surfaces 52*a* and 52*b* extend over the entire lengths in the paper width direction of the returning manifolds 47*a*, 47*b*, respectively, there is no limitation to this. It is allowable that in the upper surface of each of the supplying manifold and the returning manifold, only a certain part in the paper width direction is a curved surface, and a remaining part different from the certain part is a flat surface parallel to the paper width direction and the conveyance direction.

Figure 16A:
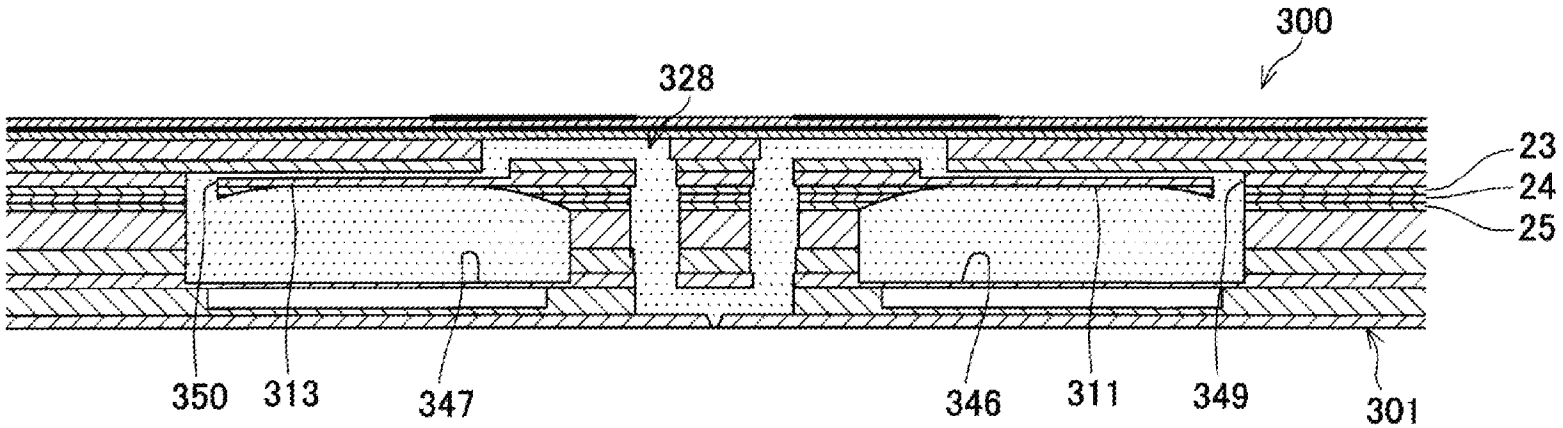
FIG. 16A is a cross-sectional view of a head unit 300 of a second modification, corresponding to FIG. 4A.
Figure 16B:
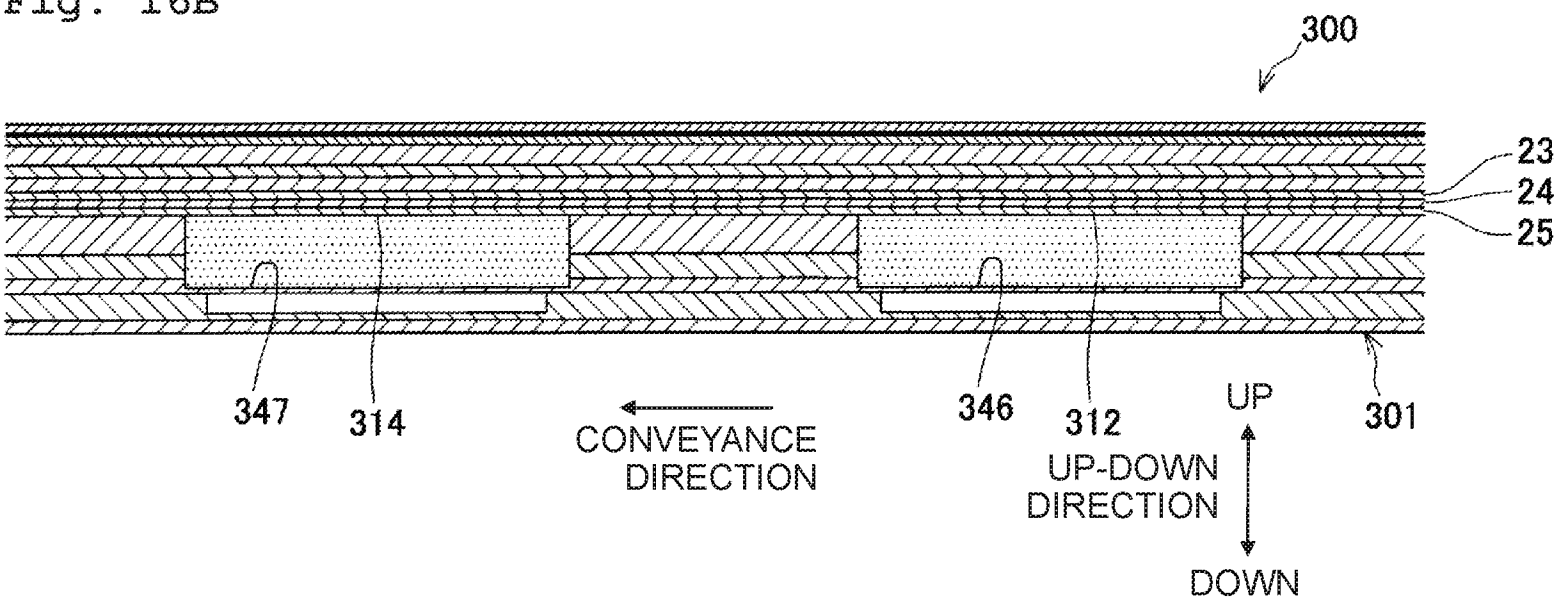
FIG. 16B is a cross-sectional view corresponding to FIG. 16A and depicting a right-side part, of the head unit 300 of the second modification, which are located on the right side in the paper width direction relative to connecting parts 349 and 350 with respect to a plurality of individual channels 328.

For example, in a second modification, in an upper surface of a supplying manifold 346 in a channel unit 301 of a head unit 300, a certain area in which connecting parts 349 with respect to a plurality of individual channels 328, respectively, are arranged and a part positioned at a left-side area which is located on the left side in the paper width direction of the certain area are made to be a curved surface 311 which is similar to the curved surface 51, as depicted in FIGS. 16 and 17. Further, in the upper surface of the supplying manifold 346, a right-side area located on the right side in the paper width direction of the certain area in which the connecting parts 349 with respect to the plurality of individual channels 328, respectively, are arranged is made to be a flat surface 312 which is parallel to the paper width direction and the conveyance direction.

Furthermore, in an upper surface of a returning manifold 347, a certain area in which connecting parts 350 with respect to the plurality of individual channels 328, respectively, are arranged and a part positioned at a left-side area which is located on the left side in the paper width direction of the certain area are made to be a curved surface 313 which is similar to the curved surfaces 52*a*, 52*b*. Moreover, in the upper surface of the returning manifold 347, a right-side area located on the right side in the paper width direction of the certain area in which the connecting parts 350 with respect to the plurality of individual channels 328, respectively, are arranged is made to be a flat surface 314 which is parallel to the paper width direction and the conveyance direction.

Figure 17A:
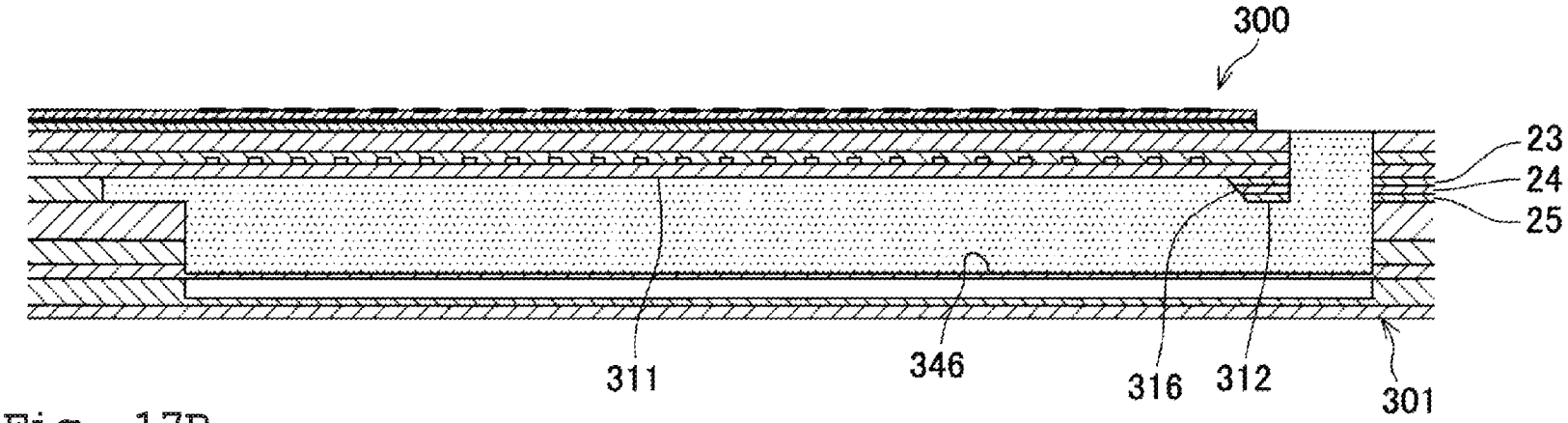
FIG. 17A is a cross-sectional view of a supplying manifold 346, of the head unit 300 of the second modification, along the paper width direction.

Further, also in the second modification, as depicted in FIG. 17A, the curved surface 311 and the flat surface 312 are smoothly connected via an inner wall surface 316, which is inclined with respect to the vertical direction, of through holes formed in the plates 23 to 25 by means of etching. Here, the inclination angle of the inner wall surface 316 with respect to the vertical direction is approximately in a range of 30 degrees to 45 degrees. In a case that the inclination angle of the inner wall surface 316 is within this range, it is possible to prevent the air bubble from flowing backward from the curved surface 311 toward the flat surface 312.

Figure 17B:
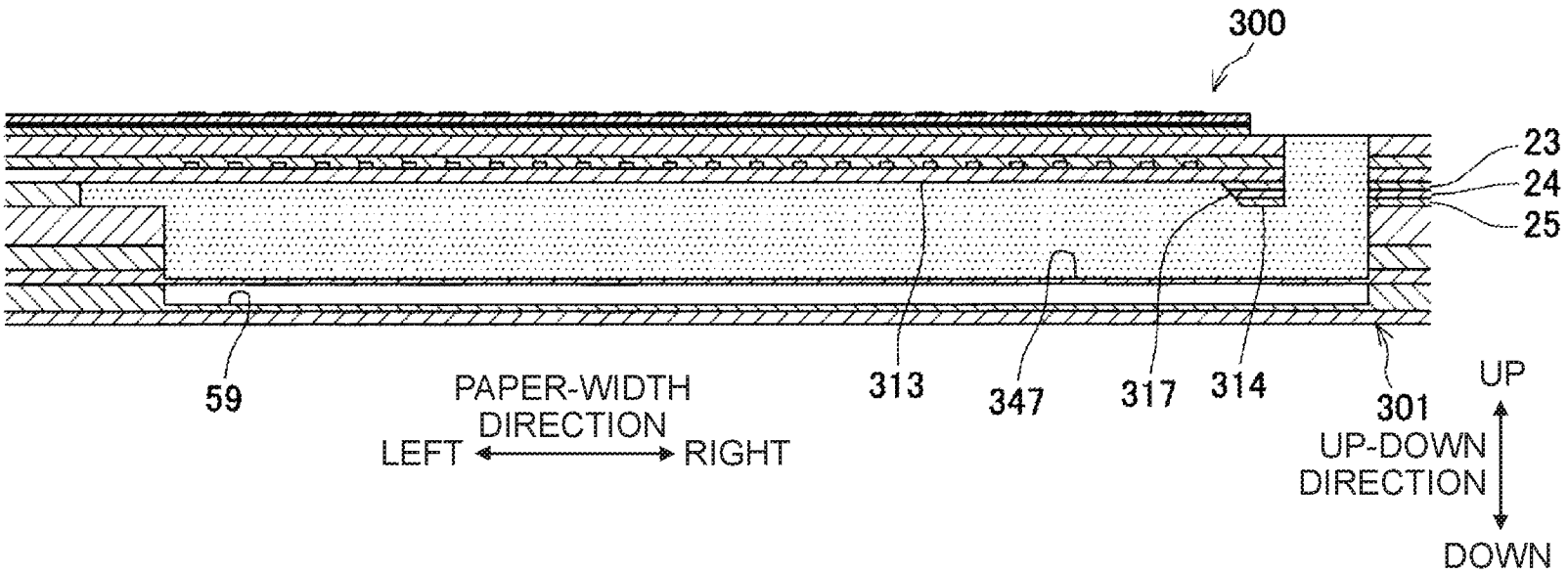
FIG. 17B is a cross-sectional view of a returning manifold 347, of the head unit 300 of the second modification, along the paper width direction.

Similarly, as depicted in FIG. 17B, the curved surface 313 and the flat surface 314 are smoothly connected via an inner wall surface 317, which is inclined with respect to the vertical direction, of through holes formed in the plates 23 to 25 by means of the etching. Here, the inclination angle of the inner wall surface 317 with respect to the vertical direction is approximately in a range of 30 degrees to 45 degrees.

In a case that, as in the second modification, at least a part of the upper surface of the returning manifold 347, the part including the area in which the connecting parts 350 with respect to the individual channels 328, respectively, are arranged, is made to be the curved surface 313, it is possible to prevent the air bubble, discharged from the individual channels 328 to the returning manifold 347, from flowing backward from the returning manifold 347 into the individual channels 328.

Further, in a case that at least a part of the upper surface of the supplying manifold 346, the part including the area in which the connecting parts 349 with respect to the individual channels 328, respectively, are arranged, is made to be the curved surface 311, it is possible to prevent the air bubble from flowing into the individual channels 328 when allowing the ink from flowing from the supplying manifold 346 into the individual channels 328.

Furthermore, in the second modification, the curved surface 311 and the flat surface 312 of the upper surface of the supplying manifold 346 are smoothly connected via the inner wall surface 316 which is inclined with respect to the vertical direction. Moreover, the curved surface 313 and the flat surface 314 of the upper surface of the returning manifold 347 are smoothly connected via the inner wall surface 317 which is inclined with respect to the vertical direction. With this, any air bubble is not easily allowed to remain at a boundary part between the curved surface 311 and the flat surface 312 and at a boundary part between the curved surface 313 and the flat surface 314.

Further, in the second modification, although the curved surface 311 and the flat surface 312 are smoothly connected due to the inclination of the wall surface 316 with respect to the vertical direction, and the curved surface 313 and the flat surface 314 are smoothly connected due to the inclination of the wall surface 317 with respect to the vertical direction, there is no limitation to this. It is allowable that each of the inner wall surfaces 316 and 317 may be a vertical surface.

Furthermore, in the first embodiment, although the upper surfaces of the supplying manifold 46, the returning manifold 47 and the bypass channel 48 are each a curved surface, there is no limitation to this. Provided that at least the upper surface of the returning manifold 47 is made to be the curved surface, it is allowable that the upper surface of each of the supplying manifold 46 and the bypass channel 48 may be a flat surface parallel to the paper width direction and the conveyance direction.

Moreover, in the first embodiment, although the upper surface of each of the supplying manifold 46 and the returning manifold 47 is made to be a curved surface to thereby make the upper surface to be a surface having a convex part having a shape which is convex upward, there is no limitation to this.

For example, it is allowable to make the upper surface of the supplying manifold 46 to be an inclined surface which is inclined with respect to the conveyance direction such that the upper surface is located at an upper position as approaching more closely toward the central side in the conveyance direction, to thereby make the upper surface to be a surface having a convex part having a shape which is convex upward. This is similarly applicable also to the upper surface of the supplying manifold 146 of the second embodiment. Further, it is allowable to make the upper surface of the returning manifold 47*a* to be an inclined surface which is inclined with respect to the conveyance direction such that the upper surface is located at an upper position as approaching more closely toward the central side in the conveyance direction, to thereby make the upper surface to be a surface having a convex part having a shape which is convex upward. This is similarly applicable also to the upper surface of the returning manifold 147 of the second embodiment. Furthermore, it is allowable to make the upper surface of the returning manifold 47*b* to be an inclined surface which is inclined with respect to the conveyance direction such that the upper surface is located at an upper position as approaching in the conveyance direction more closely toward the opposite side to the connecting part 50 with respect to the individual channels 38.

Moreover, in the first embodiment, although the bypass channel 48 connects the upper end parts of the left-side end parts on the left side in the paper width direction of the supplying manifolds 46 and the upper end parts of the left-side end parts on the left side in the paper width direction of the returning manifolds 47 with one another and each of the supplying manifolds 46 and the returning manifolds 47 has a part or portion which is located below the bypass channel 48, there is no limitation to this.

For example, it is allowable that the bypass channel connects parts which are different from the upper end parts of the left-side end parts in the paper width direction of the supplying manifolds 46 and parts which are different from the upper end parts of the left-side end parts in the paper width direction of the returning manifolds 47 with one another. Alternatively, it is allowable that the bypass channel extends over the entire length in the up-down direction of each of the supplying manifolds 46 and the returning manifolds 47.

Further, also in the first embodiment, it is allowable to omit the bypass channel connecting the supplying manifolds 46 and the returning manifolds 47, similarly to the second embodiment.

Furthermore, in each of the first and second embodiments, although the curved surface (convex part) is formed by stacking the plurality of plates which are formed with the through holes which have different shapes as projected in the up-down direction, there is no limitation to this. For example, in the first embodiment, it is allowable to form a recessed part by performing half-etching on the lower surface of the plate 23 and to stack the plate 23 formed with the recessed part and the plates 24 and 25 formed with through holes, thereby forming a curved surface.

Moreover, the present disclosure is not limited to or restricted by forming the convex part by stacking the plurality of plates each of which is formed with one of through holes or a recessed part, shapes of the through holes as projected in the up-down direction being different from each other. For example, it is allowable to form a curved surface, which serves as the upper surface of each of the supplying manifold, the returning manifold, and the bypass channel, in one piece of plate of which thickness is great.

Further, in the description above, the explanation has been given about the example in which the present disclosure is applied to the printer provided with a so-called line head. However, the example to which the present disclosure is applicable is not limited to this. The present disclosure is applicable also to a so-called serial head which is mounted on a carriage and which is configured to jet an ink(s) from a nozzle(s) while moving in the paper width direction together with the carriage.

Furthermore, in the description above, although the explanation has been given about the example in which the present disclosure is applied to the ink-jet head which is configured to jet an ink(s) from a nozzle(s), there is no limitation to this. For example, the present disclosure is applicable also to a liquid discharge apparatus configured to discharge liquid different from the ink(s), such as a resin and/or metal provided in a liquid form.

What is claimed is:

1. A liquid discharge head comprising:

a plurality of individual channels arranged in a row in a first direction which is horizontal, the plurality of individual channels including a plurality of nozzles, respectively;

an inflow channel extending in the first direction, connected to the plurality of individual channels and configured to allow liquid to inflow therethrough into the plurality of individual channels; and an outflow channel extending in the first direction, connected to the plurality of individual channels and configured to allow the liquid to outflow therethrough from the plurality of individual channels, wherein first connecting parts connected respectively to the plurality of individual channels are provided on both end parts in a second direction of an upper surface of the outflow channel, the second direction being horizontal and orthogonal to the first direction, wherein the upper surface of the outflow channel has a convex part having a shape which is, as projected in the first direction, convex upward, and wherein a highest point of the convex part is located, in the second direction, between the both end parts in the second direction of the upper surface of the outflow channel.

2. The liquid discharge head according to claim 1, wherein each of the plurality of individual channels includes:

a first channel part including a first pressure chamber and connecting each of the individual channels and the inflow channel; and a second channel part including a second pressure chamber and connecting each of the individual channels and the outflow channel, and wherein each of the first connecting parts is connected to the second channel part at one of the both end parts in the second direction of the upper surface of the outflow channel.

3. The liquid discharge head according to claim 1, wherein each of the individual channels includes:

a pressure chamber;

a communicating passage communicating one of the nozzles and the pressure chamber;

a first connecting channel connecting the communicating passage and the inflow channel; and a second connecting channel connecting the pressure chamber and the outflow channel, and wherein each of the first connecting parts is connected to the second connecting channel at one of the both end parts in the second direction of the upper surface of the outflow channel.

4. The liquid discharge head according to claim 1, wherein a discharge port for the liquid is formed in the upper surface of the outflow channel, and wherein the convex part in the upper surface of the outflow channel extends in the first direction up to the discharge port.

5. The liquid discharge head according to claim 1, wherein a discharge port for the liquid is formed in the upper surface of the outflow channel, and wherein a highest point of the convex part of the outflow channel is located at an upper position as approaching in the first direction more closely to the discharge port.

6. The liquid discharge head according to claim 1, wherein second connecting parts connected respectively to the plurality of individual channels are provided on both end parts in the second direction of an upper surface of the inflow channel, wherein the upper surface of the inflow channel has a convex part having a shape which is, as projected in the first direction, convex upward, and wherein a highest point of the convex part is located, in the second direction, between the both end parts in the second direction of the upper surface of the inflow channel.

7. The liquid discharge head according to claim 6, wherein a supply port for the liquid is formed in the upper surface of the inflow channel, and wherein the convex part in the upper surface of the inflow channel extends in the first direction up to the supply port.

8. The liquid discharge head according to claim 1, wherein a supply port for the liquid is formed in an end part on one side in the first direction of an upper surface of the inflow channel, wherein a discharge port for the liquid is formed in an end part on the one side in the first direction of the upper surface of the outflow channel, and wherein the liquid discharge head further comprises a bypass channel connecting an end part on the other side in the first direction of the inflow channel and an end part on the other side in the first direction of the outflow channel.

9. The liquid discharge head according to claim 8, wherein the bypass channel connects an upper end part of the end part on the one side in the first direction of the inflow channel and an upper end part of the end part on the one side in the first direction of the outflow channel.

10. The liquid discharge head according to claim 9, wherein the inflow channel and the outflow channel each have a part which is located at a position below the bypass channel.

11. The liquid discharge head according to claim 9, wherein the bypass channel has, in an upper surface thereof, a convex part having a shape which is convex upward, and wherein an upper surface of a connecting part, of the inflow channel, connected to the bypass channel, an upper surface of a connecting part, of the outflow channel, connected to the bypass channel, an upper surface of a connecting part of the bypass channel, connected to the inflow channel and an upper surface of a connecting part of the bypass channel, connected to the outflow channel are configured to form a continuous surface.

12. The liquid discharge head according to claim 11, wherein a highest point of the convex part in the upper surface of the bypass channel is located at an upper position as approaching in the second direction, from the connecting part connected to the inflow channel, more closely to the connecting part connected to the outflow channel.

13. The liquid discharge head according to claim 8, wherein a highest point of the convex part in the upper surface of the inflow channel is located at an upper position as approaching more closely to the other side in the first direction.

14. The liquid discharge head according to claim 1, wherein the outflow channel has the convex part at a part in the upper surface of the outflow channel, the part including an area in which the first connecting parts connected respectively to the plurality of individual channels are arranged.

15. The liquid discharge head according to claim 14, wherein the convex part of the upper surface of the outflow channel and a part, of the upper surface of the outflow channel, different from the convex part are continuously connected.

16. The liquid discharge head according to claim 1, wherein the convex part is curved so as to convex upward.

17. The liquid discharge head according to claim 1, wherein the outflow channel includes not less than three outflow channels which are arranged side by side in the second direction with an interval therebetween, wherein the nozzles are located between two outflow channels which are included in the not less than three outflow channels and which are adjacent to each other in the second direction, wherein the plurality of individual channels are arranged side by side in the first direction so as to form not less than two individual channel rows, the not less than three outflow channels include:

two outer-side outflow channels which are located on outermost sides in the second direction, respectively; and an inner-side outflow channel which is different from the two outer-side outflow channels, wherein the first connecting parts connected respectively to the individual channels, which construct one individual channel row of the not less than two individual channel rows, are provided on each of end parts, on one and the other sides in the second direction, of an upper surface of the inner-side outflow channel, and wherein the convex part in the upper surface of the inner-side outflow channel is shaped such that a highest point of the convex part is located at a central part in the second direction of the inner-side outflow channel.

18. The liquid discharge head according to claim 17, wherein the first connecting parts connected respectively to the individual channels, which constructs the one individual channel row, are provided on an outer-side end part, in the second direction, of an upper surface of each of the two outer-side outflow channels, and wherein the convex part in the upper surface of each of the two outer-side outflow channels is shaped such that a highest point of the convex part is located at an inner-side end part on an inner side in the second direction of each of the two outer-side outflow channels.

19. The liquid discharge head according to claim 1, wherein the convex part is formed by stacking a plurality of plates each of which is formed with one of through holes or a recessed part, shapes of the through holes as projected in a vertical direction being different from each other.

* * * * *